US010611172B2

(12) United States Patent
Ozawa

(10) Patent No.: US 10,611,172 B2
(45) Date of Patent: Apr. 7, 2020

(54) CONTROL DEVICE AND METHOD FOR PRINTING OBJECT IMAGE AND ADDITIONAL IMAGE

(71) Applicant: BROTHER KOGYO KABUSHIKI KAISHA, Nagoya, Aichi (JP)

(72) Inventor: Ryohei Ozawa, Nagoya (JP)

(73) Assignee: BROTHER KOGYO KABUSHIKI KAISHA, Nagoya, Aichi (JP)

( * ) Notice: Subject to any disclaimer, the term of this patent is extended or adjusted under 35 U.S.C. 154(b) by 81 days.

(21) Appl. No.: 15/469,624

(22) Filed: Mar. 27, 2017

(65) Prior Publication Data

US 2017/0282591 A1 Oct. 5, 2017

(30) Foreign Application Priority Data

Mar. 31, 2016 (JP) ..... 2016-071327

(51) Int. Cl.

| | |
|---|---|
| ***B41J 2/045*** | (2006.01) |
| ***B41J 2/21*** | (2006.01) |
| ***B41J 11/00*** | (2006.01) |
| ***B41J 13/08*** | (2006.01) |
| ***B41J 29/38*** | (2006.01) |

(52) U.S. Cl.

CPC ..... *B41J 2/2132* (2013.01); *B41J 2/04501* (2013.01); *B41J 11/007* (2013.01); *B41J 11/008* (2013.01); *B41J 13/08* (2013.01); *B41J 29/38* (2013.01)

(58) Field of Classification Search

CPC .... B41J 2/04501; B41J 11/008; B41J 2/2132; G06T 1/0021; G06F 3/1243

See application file for complete search history.

(56) References Cited

U.S. PATENT DOCUMENTS

| | | | | |
|---|---|---|---|---|
| 6,721,439 | B1 | 4/2004 | Levy et al. | |
| 2005/0007413 | A1* | 1/2005 | Uchisako | B41J 3/54 347/40 |
| 2009/0051954 | A1* | 2/2009 | Miyata | G06F 3/1205 358/1.13 |
| 2011/0037800 | A1* | 2/2011 | Tanoue | B41J 2/2114 347/12 |

(Continued)

FOREIGN PATENT DOCUMENTS

| | | | |
|---|---|---|---|
| JP | 2000-168183 | A | 6/2000 |
| JP | 2005-088387 | A | 4/2005 |

(Continued)

*Primary Examiner* — Alessandro V Amari
*Assistant Examiner* — Kendrick X Liu
(74) *Attorney, Agent, or Firm* — Scully, Scott, Murphy & Presser, P.C.

(57) ABSTRACT

A control device is for controlling a printer. The printer is configured to print by alternatively performing partial printing and sheet conveying. The printer includes a conveyer and a print head. The control device performs: acquiring an object image data representing an object image and additional image data representing an additional image added to the object image, where the additional image has a first length in an area; determining a position of the object image and a position of the additional image in the arrangement area such that the first length of the additional image at the position is minimized, where the first length is greater than or equal to zero.

15 Claims, 13 Drawing Sheets

(56) References Cited

U.S. PATENT DOCUMENTS

2011/0205280 A1* 8/2011 Koshikawa ..... B41J 13/0027
347/16

FOREIGN PATENT DOCUMENTS

| | | | |
|---|---|---|---|
| JP | 2006-344106 | A | 12/2006 |
| JP | 2007-045133 | A | 2/2007 |
| JP | 2009-023214 | A | 2/2009 |
| JP | 4226897 | B2 | 2/2009 |

* cited by examiner

EMBODIMENT

SHEET
CA1
CA2
HT1
S
TA1
NA1
MA1
HM1
NA2
HM2
MA2
NA3
HT2
TA2
AR
X
Y
Z

ARRANGEMENT AREA
(NO MARGINS)
OI
CA1(AI)
Ob1
ABCD
WM
CONFIDENTIAL
Ob2
BG

ARRANGEMENT AREA
(WITH MARGINS)

FIRST EMBODIMENT

FIRST EMBODIMENT

FIRST EMBODIMENT

BEFORE CORRECTION

AFTER CORRECTION

SECOND EMBODIMENT

SECOND EMBODIMENT

THIRD EMBODIMENT

CONTROL DEVICE AND METHOD FOR PRINTING OBJECT IMAGE AND ADDITIONAL IMAGE

CROSS REFERENCE TO RELATED APPLICATION

This application claims priority from Japanese Patent Application No. 2016-071327 filed Mar. 31, 2016. The entire content of the priority application is incorporated herein by reference.

TECHNICAL FIELD

The present disclosure relates to a technology for printing an image including an object image and an additional image.

BACKGROUND

There is known a technology that, when a plurality of document sets each including a plurality of pages are printed, adds different marks for each page group of each document set.

SUMMARY

However, in the above technology, sufficient consideration has not been given to the position to which a mark is added. Thus, a time required for printing a marked page may become excessively long. Such a problem may occur not only in printing of the marked page but also in printing of a print image including an object image and an additional image such as a mark.

The present specification discloses a technology that can prevent a time required for printing an image including an object image and an additional image from increasing.

According to one aspect, the disclosure provides a control device for controlling a printer. The printer is configured to print a print image by alternatively performing partial printing and sheet conveying plural times, and includes a conveyer configured to convey a sheet in a first direction in the sheet conveying and a print head having a plurality of nozzles each configured to eject a droplet of ink onto the sheet. The print head is configured to print a part of the print image in the partial printing. The control device includes a processor including hardware, and a memory storing computer-readable instructions therein. The computer-readable instructions, when executed by the processor, causes the control device to perform: acquiring an object image data representing an object image and additional image data representing an additional image added to the object image; determining a first position of the object image and a second position of the additional image in an arrangement area including a first area and a second area positioned at positions different from each other in the first direction, the second area being a band-like area extending in a second direction crossing the first direction, the first area being an area where the sheet conveying including a first conveying is performed at least once when an image in the first area is printed, the second area being an area where the sheet conveying including a second conveying different from the first conveying is performed at least once when an image in the second area is printed, and printing an image in the second area taking time longer than that in the first area because of difference of the sheet conveying between in the first area and in the second area, wherein the second position of the additional image is determined such that the additional image has a first length in the first direction within the second area and the first length is minimized, where the first length is greater than or equal to zero; generating arrangement image data representing an arrangement image including the object image and the additional image by arranging the object image and the additional image respectively at the first position and the second position that are determined in the determining; and supplying, to the printer, print image data generated by using the arrangement image data.

According to another aspect, the disclosure provides a non-transitory computer readable storage medium storing a set of program instructions installed on and executed by a computer for controlling a printer. The printer is configured to print a print image by alternatively performing partial printing and sheet conveying plural times, and includes a conveyer configured to convey a sheet in a first direction in the sheet conveying and a print head having a plurality of nozzles each configured to eject a droplet of ink onto the sheet. The print head is configured to print a part of the print image in the partial printing. The program instructions include: acquiring an object image data representing an object image and additional image data representing an additional image added to the object image; determining a first position of the object image and a second position of the additional image in an arrangement area including a first area and a second area positioned at positions different from each other in the first direction, the second area being a band-like area extending in a second direction crossing the first direction, the first area being an area where the sheet conveying including a first conveying is performed at least once when an image in the first area is printed, the second area being an area where the sheet conveying including a second conveying different from the first conveying is performed at least once when an image in the second area is printed, and printing an image in the second area taking time longer than that in the first area because of difference of the sheet conveying between in the first area and in the second area, wherein the second position of the additional image is determined such that the additional image has a first length in the first direction within the second area and the first length is minimized, where the first length is greater than or equal to zero; generating arrangement image data representing an arrangement image including the object image and the additional image by arranging the object image and the additional image respectively at the first position and the second position that are determined in the determining; and supplying, to the printer, print image data generated by using the arrangement image data.

According to another aspect, the disclosure provides a method for controlling a printer. The printer is configured to print a print image by alternatively performing partial printing and sheet conveying plural times, and includes a conveyer configured to convey a sheet in a first direction in the sheet conveying and a print head having a plurality of nozzles each configured to eject a droplet of ink onto the sheet. The print head is configured to print a part of the print image in the partial printing. The method includes: acquiring an object image data representing an object image and additional image data representing an additional image added to the object image; determining a first position of the object image and a second position of the additional image in an arrangement area including a first area and a second area positioned at positions different from each other in the first direction, the second area being a band-like area extending in a second direction crossing the first direction, the first area being an area where the sheet conveying including a first conveying is performed at least once when an image in the first area is printed, the second area being an area where the sheet conveying including a second conveying different from the first conveying is performed at least once when an image in the second area is printed, and printing an image in the second area taking time longer than that in the first area because of difference of the sheet conveying between in the first area and in the second area, wherein the second position of the additional image is determined such that the additional image has a first length in the first direction within the second area and the first length is minimized, where the first length is greater than or equal to zero; generating arrangement image data representing an arrangement image including the object image and the additional image by arranging the object image and the additional image respectively at the first position and the second position that are determined in the determining; and supplying, to the printer, print image data generated by using the arrangement image data.

BRIEF DESCRIPTION OF THE DRAWINGS

The particular features and advantages of the disclosure will become apparent from the following description taken in connection with the accompanying drawings, in which.

DETAILED DESCRIPTION

A. First Embodiment

A1: Configuration of Terminal Device 200

Figure 1:
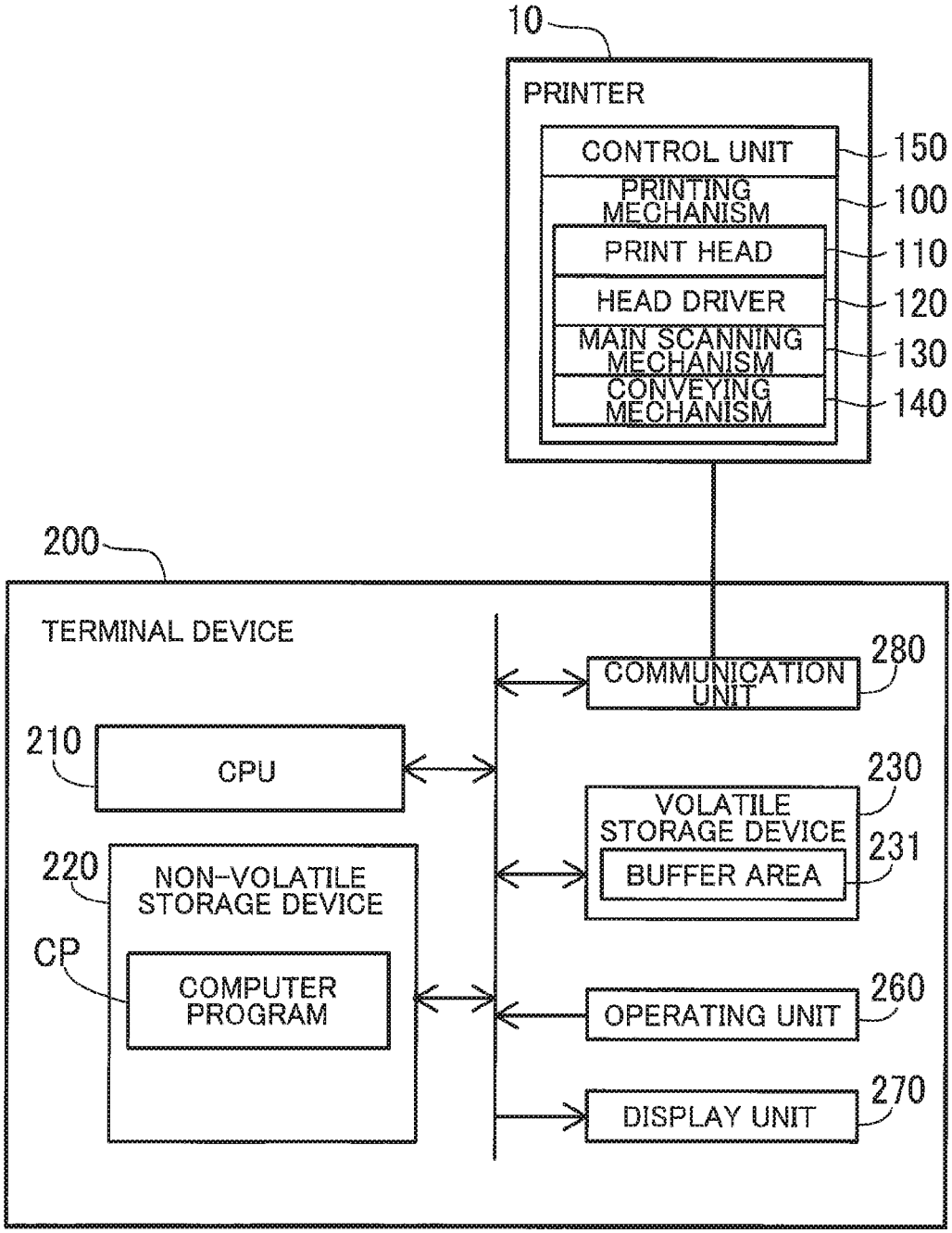
FIG. 1 is a block diagram illustrating configurations of a terminal device and a printer according to a first embodiment.

The present invention will be described based on a first embodiment. FIG. 1 is a block diagram illustrating configurations of a terminal device 200 as a control device in the embodiment and a printer 10 as a printing unit.

The terminal device 200 is, for example, a personal computer and includes a CPU 210 as a controller for controlling the operation of the terminal device 200, a non-volatile storage device 220 such as a hard disk, a volatile storage device 230 such a RAM, an operating unit 260 such as a mouse or a keyboard, a display unit 270 such as a liquid crystal display, and a communication unit 280. The terminal device 200 is communicably connected to an external device such as the printer 10 through the communication unit 280.

The volatile storage device 230 provides a buffer area 231 that temporarily stores various intermediate data generated when the CPU 210 performs processing. The non-volatile storage device 220 stores a computer program CP. In the present embodiment, the computer program CP is a printer driver program for controlling the printer 10 and is provided by being downloaded from a server. Alternatively, the computer program CP may be provided by being stored in a DVD-ROM. The CPU 210 executes the computer program CP to thereby execute print processing to be described later.

The printer 10 includes an inkjet printing mechanism 100 and a control unit 150 including a CPU for controlling the inkjet printing mechanism 100 and a memory.

The printing mechanism 100 performs printing by ejecting inks (ink droplets) of different colors: cyan (C), magenta (M), yellow (Y), and black (K). The printing mechanism 100 includes a print head 110, a head driver 120, a main scanning mechanism 130, and a conveying mechanism 140.

Figure 2:
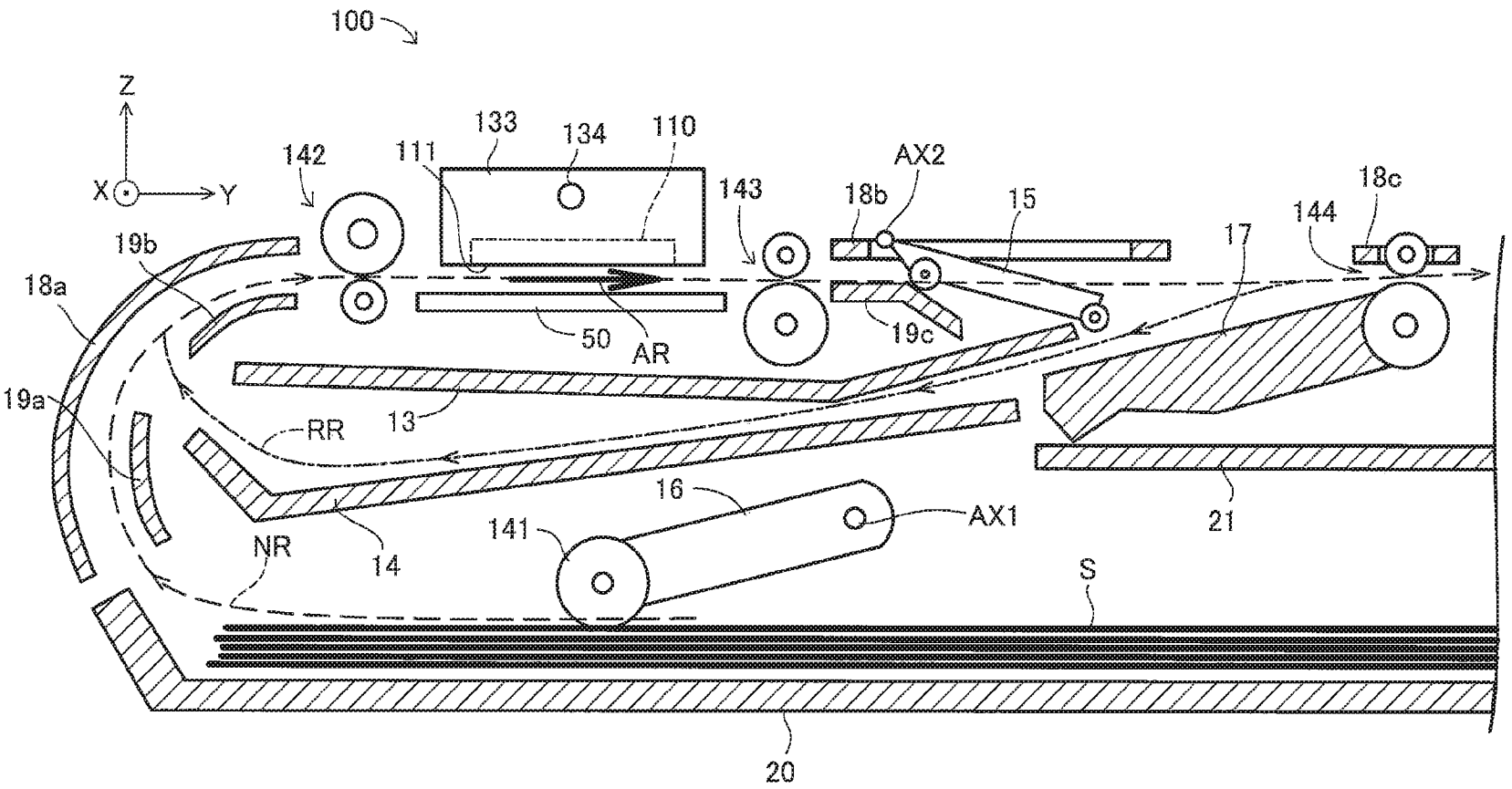
FIG. 2 is a schematic view of a printing mechanism according to the first embodiment.

FIG. 2 is a view schematically illustrating a configuration of the printing mechanism 100. The printing mechanism 100 further includes a sheet supply tray 20 for housing a sheet (sheets) S before printing, a sheet discharge tray 21 onto which a printed sheet S is discharged, and a platen 50 disposed opposite to a nozzle formation surface 111 of the print head 110.

The conveying mechanism 140 conveys the sheet S along a normal path NR that extends to the sheet discharge tray 21 after passing between the print head 110 and the platen 50. The upstream end of the normal path NR is referred to merely as "upstream end", and the downstream end thereof is merely as "downstream end". More specifically, the conveying mechanism 140 includes outer guide members 18*a* to 18*c*, inner guide members 19*a* to 19*c*, a flap member 17, a sheet feed roller 141, an upstream side conveying roller pair 142, a downstream side conveying roller pair 143, and a sheet discharge roller pair 144. The outer guide members 18*a* to 18*c*, the inner guide members 19*a* to 19*c*, and the flap member 17 are disposed along the normal path NR so as to guide the sheet S. The sheet feed roller 141, the upstream side conveying roller pair 142, the downstream side conveying roller pair 143, and the sheet discharge roller pair 144 are provided on the normal path NR. The sheet feed roller 141 is fitted to the leading end of an arm 16 that is turnable about a shaft AX1 and sandwiches the sheet S between itself and the sheet supply tray 20 to support the sheet S. The respective roller pairs support the sheet S on the normal path NR. The sheet feed roller 141 and the upstream side conveying roller pair 142 can each be referred to as an upstream supporting part that supports the sheet S on the upstream side of the print head 110. Further, the downstream side conveying roller pair 143 and the sheet discharge roller pair 144 can each be referred to as a downstream supporting part that supports the sheet S on the downstream side of the print head 110. Under the control of the control unit 150, the conveying mechanism 140 drives the above supporting parts by means of a non-illustrated conveying motor to thereby convey the sheet S.

Further, by reversing the sheet discharge roller pair 144, the conveying mechanism 140 can drive the sheets in a reverse direction opposite to the direction for conveying the sheet S along the normal path NR. This allows the sheet S to be conveyed along a reverse path RR, which is a path that extends from the upstream side of the sheet discharge roller pair 144, passing between an upper guide member 13 and a lower guide member 14 to merge with the normal path NR. The conveying mechanism 140 further includes a turning member 15 configured to be turnable about a shaft AX2 to thereby prevent the sheet S conveyed on the reverse path RR from being reversely conveyed on the normal path NR.

The conveying direction AR of FIG. 2 is the sheet conveying direction (+Y direction) between the print head 110 and the platen 50.

The main scanning mechanism 130 includes a carriage 133 that carries the print head 110 and a sliding shaft 134 that holds the carriage 133 so as to be reciprocally movable in a main scan direction (X-axis direction). The main scanning mechanism 130 uses power of a non-illustrated main scanning motor to reciprocate the carriage 133 along the sliding shaft 134, whereby main scanning that reciprocates the print head 110 in the main scan direction is achieved.

Figure 3:
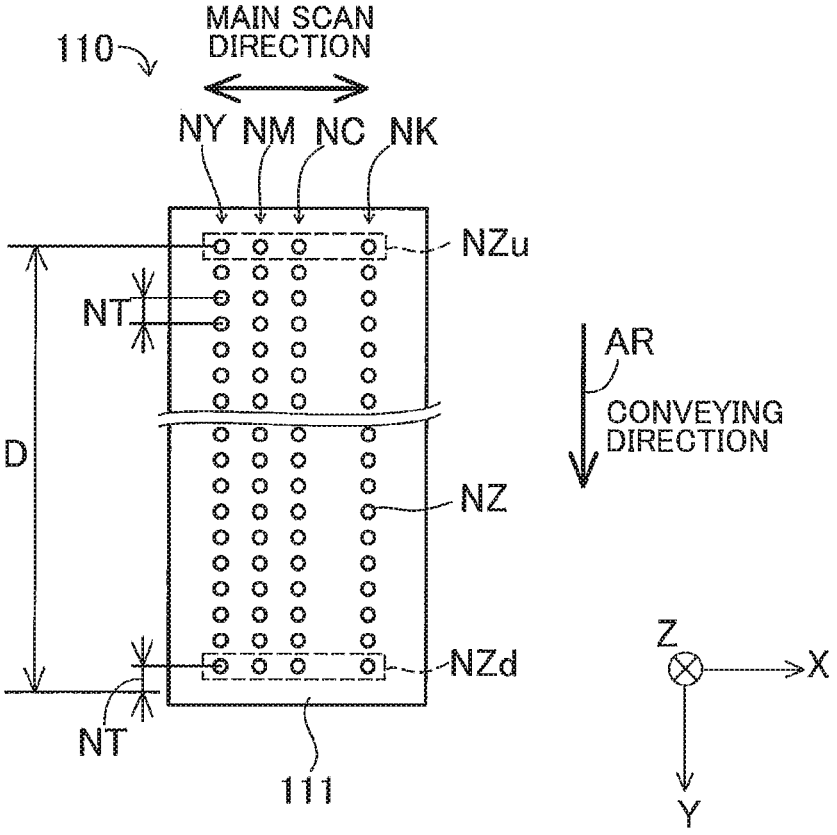
FIG. 3 illustrates a configuration of a print head according to the first embodiment.

FIG. 3 is a view illustrating a configuration of the print head 110 as viewed from −Z side (as viewed from below in FIG. 2). As illustrated in FIG. 3, the nozzle formation surface 111 of the print head 110 that is opposite to the platen 50 has a plurality of nozzle arrays each constituted of a plurality nozzles, i.e., nozzle arrays NC, NM, NY, and NK that eject the above-mentioned inks of C, M. Y, and K. Each nozzle array includes a plurality of nozzles NZ. The plurality of nozzles NZ are different in position in the conveying direction and arranged at a predetermined nozzle interval NT along the conveying direction. The nozzle interval NT is the conveying direction length between two nozzles NZ adjacently disposed in the conveying direction. The most upstream side (−Y side) nozzle NZ among the nozzles constituting each nozzle array is referred to as "most upstream side nozzle NZu". Further, the most downstream side (+Y side) nozzle NZ among the nozzles constituting each nozzle array is referred to as "most downstream side nozzle NZd". The length obtained by adding the nozzle interval NT to the length between the most upstream side nozzle NZu and the most downstream side nozzle NZd is referred to as "nozzle length D".

The head driver 120 drives the print head 110 reciprocated by the main scanning mechanism 130 on a sheet S conveyed by the conveying mechanism 140. As a result, the ink droplets are ejected from the plurality of nozzles NZ of the print head 110 onto the sheet S, whereby an image is printed on the sheet S.

The control unit 150 (FIG. 1) controls the head driver 120, main scanning mechanism 130, and conveying mechanism 140 to repeat a partial printing operation SP and a sheet conveying operation T many times in an alternate way. In a single partial printing operation SP, the ink droplets are ejected onto the sheet S from the nozzles NZ of the print head 110 while a single main scanning operation is performed with the sheet S held in a stopped state on the platen 50, whereby a part of the image to be printed is printed on the sheet S. In a single sheet conveying operation T, the sheet S is moved in the conveying direction AR by a predetermined conveyance amount.

Figure 4:
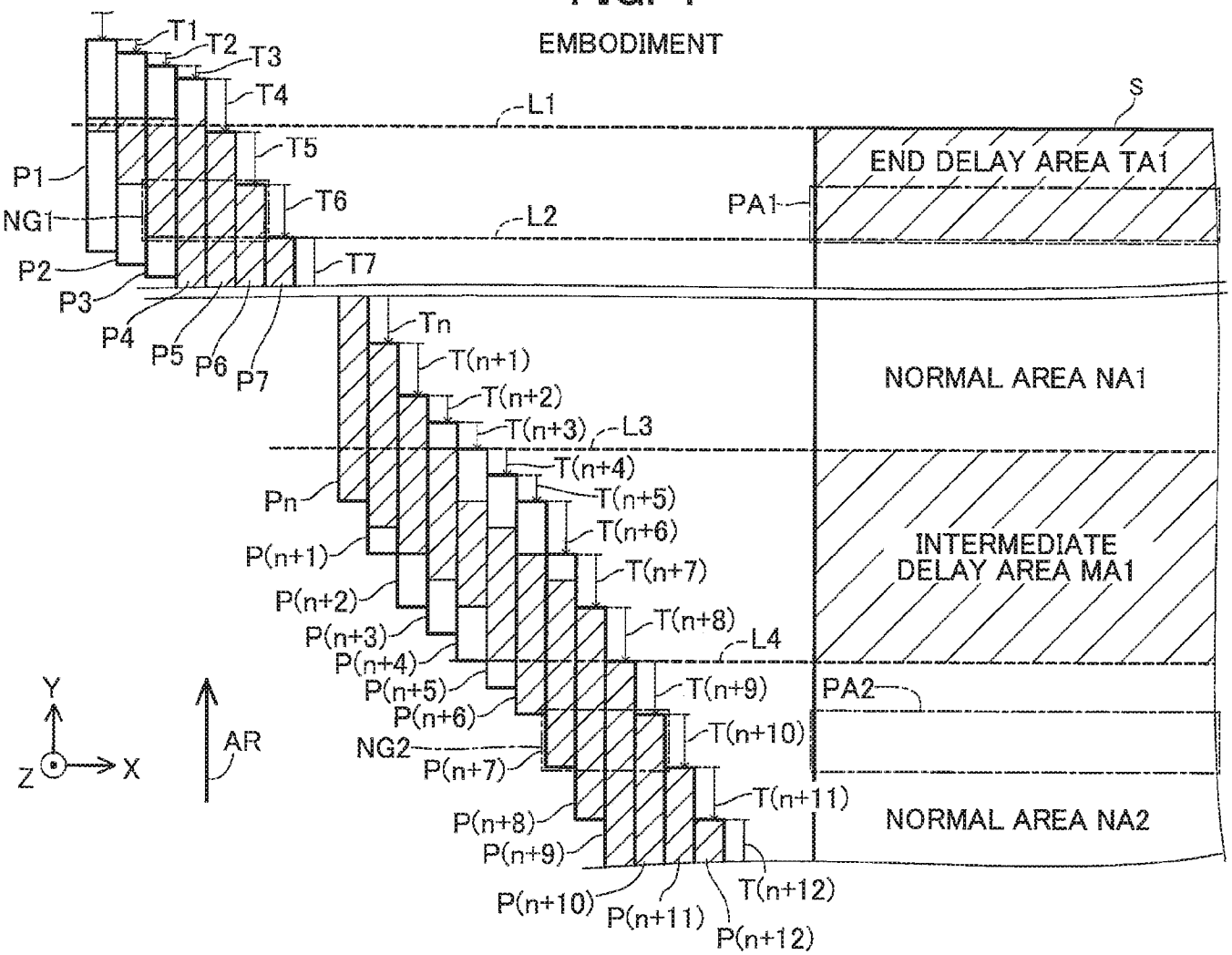
FIG. 4 is a drawing illustrating an example of a relationship between a sheet and a head position according to the first embodiment.

FIG. 4 is a view illustrating an example of the relationship between the sheet S and the head positions P. FIG. 4 illustrates the head positions P, i.e., the relative position of the print head 110 in the conveying direction with respect to the sheet S for each partial printing operation SP (i.e., for each main scanning operation). Such a relationship between the sheet S and the head positions P is predetermined for each sheet size, such as A4, A3, B5, or letter. Pass numbers k (k is an integer equal to or larger than 1) are given to a plurality of partial printing operations SP in the execution order, and k-th partial printing operation SP is referred to as "partial printing operation SPk". The head position P corresponding to the partial printing operation SPk is referred to as "head position Pk". The sheet conveying operation T performed between the k-th partial printing operation SPk and the (k+1)-th partial printing operation SP(k+1) is referred to as "k-th sheet conveying operation Tk". FIG. 4 illustrates head positions P1 to P7 corresponding to the first to seventh partial printing operations SP1 to SP7, and head positions Pn to P(n+12) corresponding to the n-th to (n+12)-th partial printing operations SPn to SP(n+12). FIG. 4 further illustrates sheet conveying operations T1 to T7 and Tn to T(n+12).

In FIG. 4, the hatched area in the rectangle representing the head position P indicates a range in which the nozzles NZ are used in the corresponding partial printing operation SP. When there is no image to be printed by the nozzles NZ (e.g., object in an object image OI to be described later or a background having a color different from white) in the range along the conveying direction AR, the corresponding partial printing operation SP is not executed. That is, if no image is to be printed in an area, the printer 10 does not perform the partial printing operation for the area.

As illustrated in FIG. 4, printing of the present embodiment is performed in a 4-pass printing mode, in which each segment area is printed using four partial printing operations SP. The sheet conveying operation T in the printing of the present embodiment has two types of operations: a normal conveying operation and a short conveying operation. Here, in the normal conveying operation, a feeding distance is (¼)D; and in the short conveying operation, a feeding distance is shorter than (¼)D. In FIG. 4, the sheet conveying operations T1 to T3 and T(n+2) to T(n+5) are the short conveying operations; and sheet conveying operations T4 to T7, Tn, T(n+1) and T(n+6) to T(n+12) are the normal conveying operations.

Figures 5A, 5B, 5C:
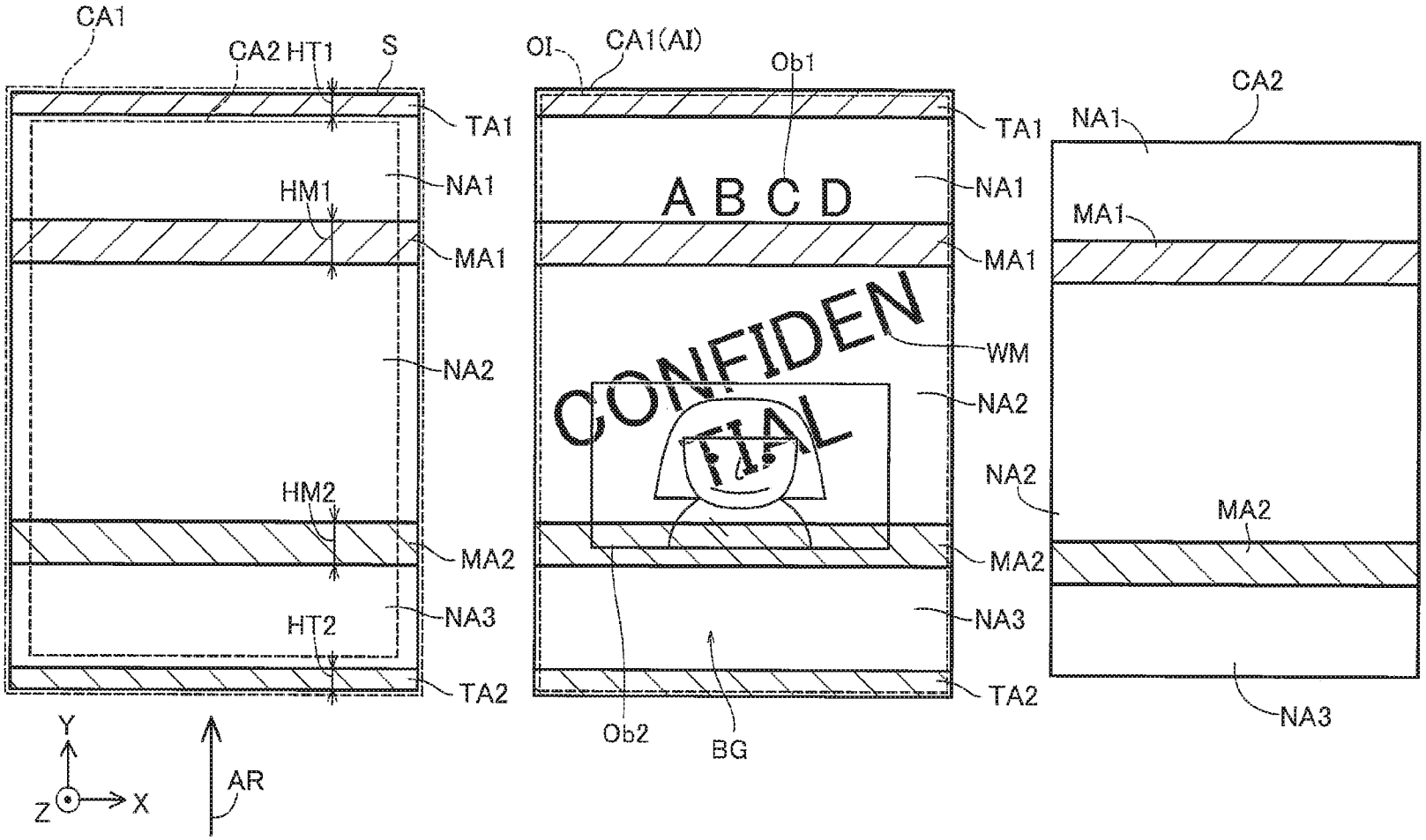
FIGS. 5A to 5C are drawings illustrating a relationship between a sheet and an arrangement area corresponding to the sheet according to the first embodiment.

FIGS. 5A to 5C are views illustrating an example of the sheet S and arrangement areas in the sheet S. As illustrated in FIG. 5A, the area of the sheet S can be divided into seven areas (four delay areas TA1, TA2, MA1, and MA2 and three normal areas NA1 to NA3). The downstream side end delay area TA1 is the area extending along the downstream end (+Y side end) of the sheet S and has a predetermined length (hereinafter, also referred to as "width") HT1 in the conveying direction AR. The upstream side end delay area TA2 is the area extending along the upstream end (−Y side end) of the sheet S and has a width HT2. The downstream side intermediate delay area MA1 is positioned between the downstream end and the center of the sheet S in the conveying direction, and has a width HM1. The upstream side intermediate delay area MA2 is positioned between the upstream end and the center of the sheet S in the conveying direction and has a width HM2.

In the normal areas NA1 to NA3, three sheet conveying operations T performed between four partial printing operations SP are all normal operations and do not include the short conveying operation. For example, In FIG. 4, a partial area PA2 in the normal area NA2 and a nozzle group NG2 for use in printing the partial area PA2 are illustrated. Four partial printing operations that print the partial area PA2 in the normal area NA2 are partial printing operations SP (n+7) to SP (n+10) corresponding to head positions P(n+7) to P(n+10). Three sheet conveying operations T(n+7) to T(n+9) between the partial printing operations SP (n+7) to SP (n+10) are all normal conveying operations.

In the delay areas TA1, TA2, MA1, and MA2, three sheet conveying operations T between the four partial printing operations SP that print a segment area in each delay area include at least one short conveying operation. Accordingly, a time required to print an image in each of the delay areas TA1, TA2, MA1, and MA2 is larger than a time required to print an image in each of the normal areas NA1 and NA2. This is because the number of nozzles NZ to be used in the partial printing operations before and after the short conveying operations is reduced, so that the number of partial printing operations required for printing increases. For example, in FIG. 4, the partial area PA1 in the end delay area TA1 and a nozzle group NG1 for use in printing the partial area PA1 are illustrated. The four partial printing operations that print the partial area PA1 in the end delay area TA1 are partial printing operations SP3 to SP6 corresponding to head positions P3 to P6. The three sheet conveying operations T3 to T5 between the partial printing operations SP3 to SP6 include one short conveying operation (T3).

For example, the short conveying operation is executed when conveying accuracy of the sheet S is likely to be lowered. Execution of the short conveying operation enables suppression of lowering of conveying accuracy of the sheet S. Further, execution of the short conveying operations enables reduction in the number of the nozzles NZ to be used in the partial printing operations before and after the short conveying operation. Accordingly, the printing area can be reduced, when conveying accuracy is likely to be lowered. As a result, deterioration of image quality due to the lowering of conveying accuracy, for example, banding can be suppressed.

For example, at a timing when a state where the sheet S is not supported by the sheet supporting part such as the roller pair is shifted to a state where the sheet S is supported by the sheet supporting part. That is, at a timing when the downstream end of the sheet S goes into the sheet supporting part, a conveying load applied to the sheet S is varied, so that conveying accuracy is likely to be lowered. Thus, in the present embodiment, the sheet conveying operations T(n+2) to T(n+5) in the vicinity of the timing when the downstream end of the sheet S goes into the sheet discharge roller pair 144 are set as the short conveying operation (FIG. 4). The intermediate delay area MA1 is the delay area corresponding to the short conveying operation at this timing.

For example, at a timing when the sheet S having been supported by the sheet supporting part such as the roller pair is shifted to an unsupported state where the sheet S is not supported by the sheet supporting part, i.e., at timing when the upstream end of the sheet S goes out of the sheet supporting part, a conveying load applied to the sheet S is varied. The conveying accuracy is therefore likely to be lowered. Thus, in the present embodiment, although not illustrated, the sheet conveying operation in the vicinity of the timing when the upstream end of the sheet S goes out of the sheet feed roller 141 is set as the short conveying operation. The intermediate delay area MA2 is the delay area corresponding to the short conveying operation at this timing.

Further, in a state where the sheet S is supported by the upstream side conveying roller pair 142 but is not supported by the downstream side conveying roller pair 143, that is, in a state where the vicinity of the downstream end of the sheet S is printed, the downstream end of the sheet S is a free end. The conveying accuracy is therefore likely to be lowered. Thus, in the present embodiment, the sheet conveying operations T1 to T3 performed when the vicinity of the downstream end of the sheet S is printed are set as the short conveying operation. The end delay area TA1 is the delay area corresponding to the short conveying operation at the downstream end of the sheet S.

Similarly, when the sheet S is not supported by the upstream side conveying roller pair 142 but is supported by the downstream side conveying roller pair 143, i.e., when the vicinity of the upstream end of the sheet S is printed, the upstream end of the sheet S is a free end. The conveying accuracy is therefore likely to be lowered. Thus, in the present embodiment, although not illustrated, the sheet conveying operation performed when the vicinity of the upstream end of the sheet S is printed is set as the short conveying operation. The end delay area TA2 is the delay area corresponding to the short conveying operation at the upstream end of the sheet S.

When there exists any image to be printed, such as an object in an object image OI to be described later or a background having a color different from white, in the delay area, the short conveying operation is performed, so that a printing time may be excessively increased as compared with a case where no image to be printed exists in the delay area.

When print data is generated in print processing to be described later, the arrangement area on which an image to be printed is disposed corresponds to the sheet S, so that as in the sheet S, the delay area and the normal area can be defined in the arrangement area.

An arrangement area CA1 of FIG. 5B is used in a so-called borderless printing mode in which printing can be made with no margin left at four side ends of the sheet S. As indicated by the dashed line in FIG. 5A, the arrangement area CA1 is associated with the sheet S. The arrangement area CA1 has almost the same size as, exactly, a size slightly larger than the sheet S. Thus, as in the sheet S, four delay areas TA1, TA2, MA1, and MA2 and three normal areas NA1 to NA3 can be defined in the arrangement area CA1.

An arrangement area CA2 of FIG. 5C is used in the bordered printing mode which is a printing mode. As indicated by the dashed line in FIG. 5A, the arrangement area CA2 is associated with the sheet S. The arrangement area CA2 has a size slightly smaller than the sheet S by the margin. Thus, as can be seen from FIG. 5A, the end delay areas TA1 and TA2 are positioned outside the arrangement area CA2, that is, not included in the arrangement area CA2. Thus, two intermediate delay areas MA1 and MA2 and three normal areas NA1 to NA3 are defined in the arrangement area CA2.

As is clear from FIGS. 5A to 5C, the delay areas TA1, TA2, MA1, and MA2 and normal areas NA1 to NA3 are areas different in position in the conveying direction AR from each other. Further, these areas TA1, TA2, MAL MA2, and NA1 to NA3 are band-like areas extending in the main scan direction of the sheet S and arrangement areas CA1 and CA2, and range over the entire length of the sheet S in the main scan direction.

A-2. Print Processing

Figure 6:
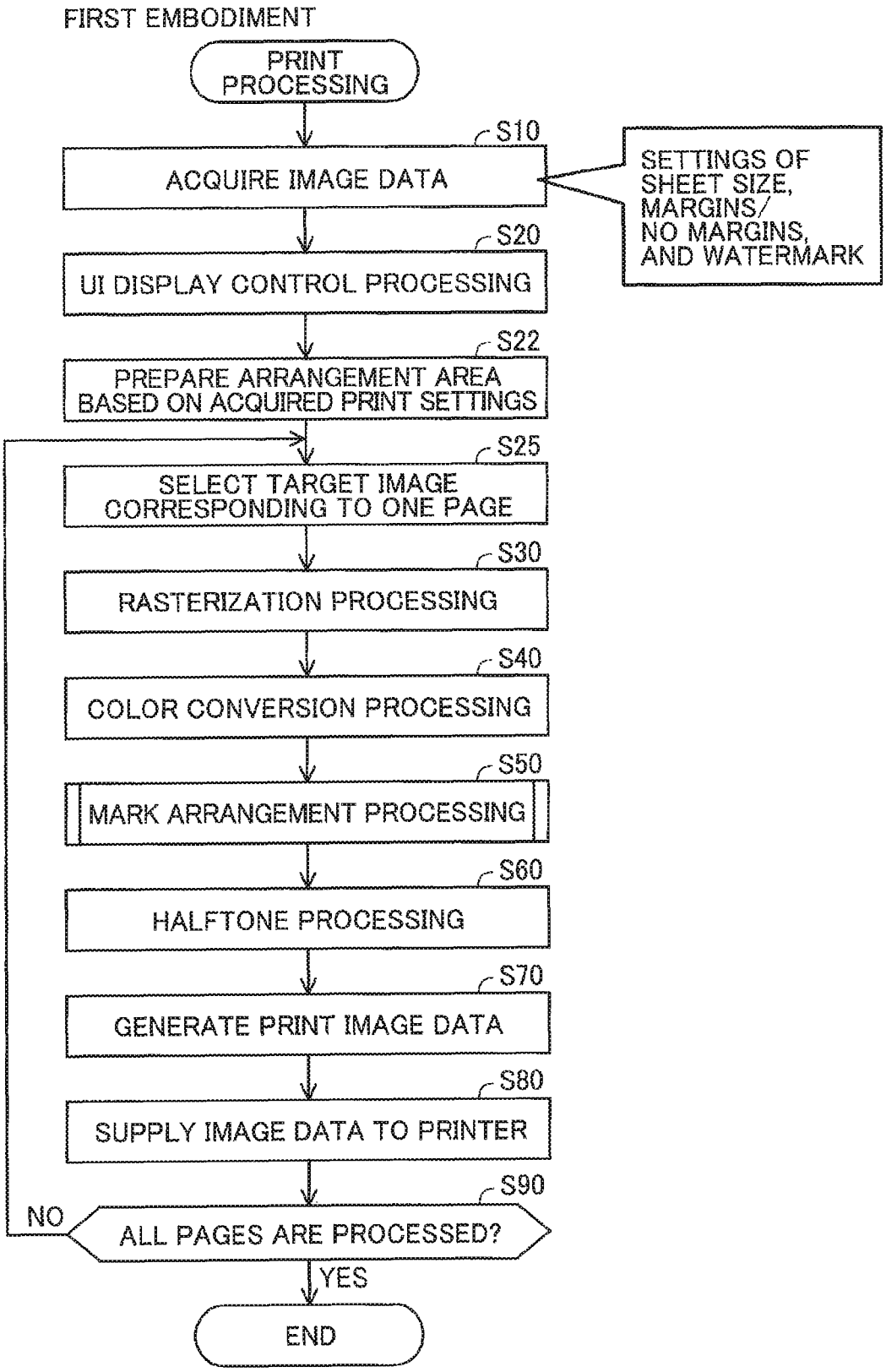
FIG. 6 is a flowchart of print processing according to the first embodiment.

FIG. 6 is a flowchart of print processing. The CPU 210 of the terminal device 200 executes the print processing of FIG. 6 as a printer driver. For example, a user inputs a print instruction to an application program such as a document creation program or a drawing creation program, and the printer driver is called by the application program, whereby the print processing of FIG. 6 is started.

In S10, the CPU acquires object image data representing an object image OI to be printed. The object image data is acquired from the application program by which the printer driver is called. The object image data represents, for example, m object images OI corresponding to m pages (m is an integer equal to or larger than 1). The object image data is, for example, data that describes the object image OI using a description method provided by an operating system (OS) of the terminal device 200. For example, when the OS is Windows® manufactured by Microsoft Corp., a description method according to the specification of GDI (Graphic Device Interface) of Windows® is used. Alternatively, the object image data may be described using PCL (Printer Control Language) or page description language such as PostScript.

FIG. 5B illustrates an example of one object image OI in the arrangement area CA1 The object image OI includes a background BG and texts Ob1 and Ob2 as objects. The color of the background BG of the object image OI is white. Thus, when the object image OI is printed on the sheet S, only the texts Ob1 and Ob2 are printed (printing of the background BS is not performed).

In S20, the CPU 210 performs a UI interface control processing in which the CPU 210 displays a user interface screen (referred to as "UI screen") on the display unit 270 and acquires print settings through the UI screen.

Figure 7A:
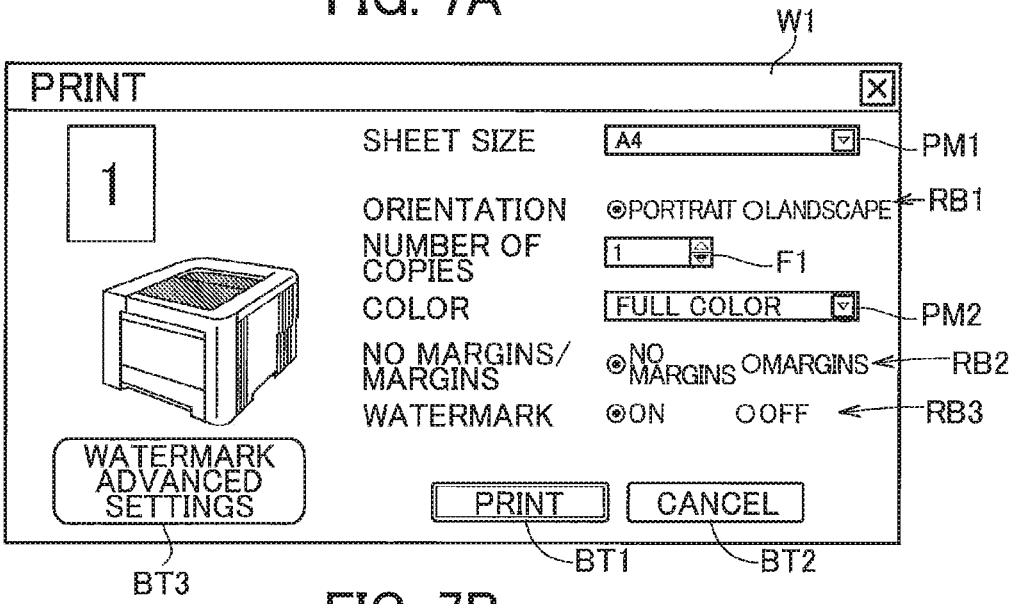
FIGS. 7A to 7C illustrate examples of UI displays according to the first embodiment.
Figure 7B:
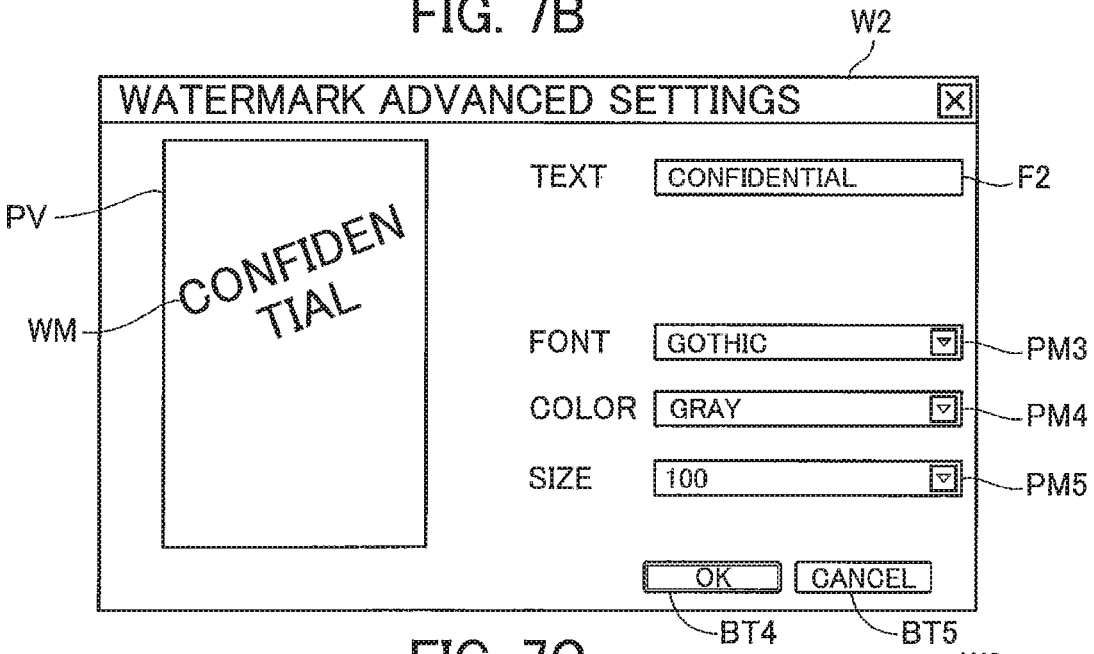
Figure 7C:
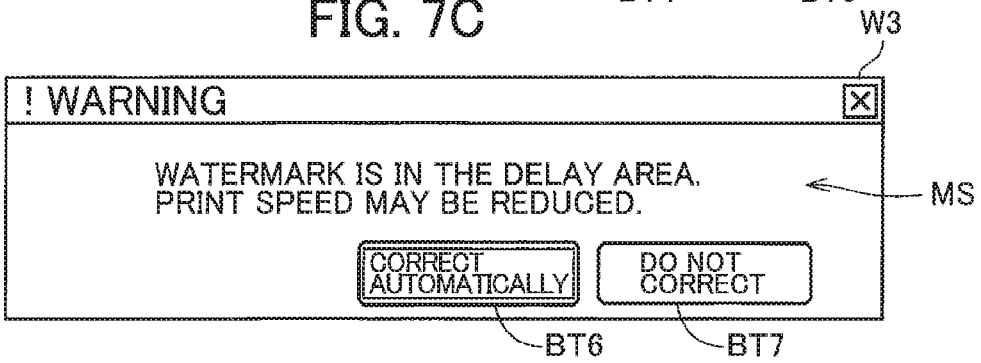

FIGS. 7A to 7C illustrate examples of a UI screens W1, W2 and W3, respectively. A main screen W1 of FIG. 7A includes pull-down menus PM1 and PM2, radio buttons RB1 to RB3, a field F1, a print button BT1, a cancel button BT2, and an advanced setting button BT3. The pull-down menus PM1 and PM2, the radio button RB1, and the field F1 are input elements for use in inputting general print settings, such as the size of the sheet S, orientation of an image with respect to the sheet S, color, and copy number. The radio button RB2 is an input element for use in inputting whether to perform the bordered printing mode or the borderless printing mode. The radio button RB3 is an input element for use in inputting whether or not to perform printing of a watermark WM (to be described later). In the present embodiment, the following description will be made assuming that printing of the watermark WM is instructed through the radio button RB3.

The watermark WM is an image to be printed based on the user's instruction together with the object image OI to be printed. It can be said that the watermark WM is a kind of additional image to be added to the object image OI in an image to be printed. The watermark WM is, e.g., a faint-colored (gray-colored, etc.) character or pattern to be added to the object image OI and is also referred to as "transparent image" or "background image". In FIG. 5B, an example of a watermark WM arranged together with the object image OH is illustrated. The watermark WM is added to indicate a kind of information (confidential information, etc.) or to prevent unauthorized copy.

When the advanced setting button BT3 on the main screen W1 of FIG. 7A is depressed, the CPU 210 displays the advanced setting screen W2 of FIG. 7B on the display unit 270 while continuing displaying the main screen W1 of FIG. 7A. The advanced setting screen W2 includes pull-down menus PM3 to PM5, a field F2, buttons BT4 and BT5, and a preview screen PV for the watermark WM. The pull-down menus PM3 to PM5 and the field F2 are input elements for use in inputting settings concerning the watermark WM to be printed. For example, the field F2 is an input element for use in inputting a text as the watermark WM. The pull-down menus PM3 to PM5 are input elements for use in inputting font, color, and size of the watermark WM as the text, respectively. On the preview screen PV, a watermark WM based on information currently inputted to the input elements PM3 to PM5 and the field F2 is displayed. The user can move the watermark WM on the preview screen PV by operating a pointing device such as a mouse and can thereby input an instruction to specify a reference position of the watermark WM that specifies the position of the watermark WM in the arrangement area.

When an OK button BT4 on the advanced setting screen W2 is depressed, the CPU 210 enables the settings input through the advanced setting screen W2 and then closes the advanced setting screen W2. When the cancel button BT5 on the advanced setting screen W2 is depressed, the CPU 210 disables the settings input through the advanced setting screen W2 and then closes the advanced setting screen W2.

The user inputs required settings on the UI screens W1 and W2 and depresses the print button BT1. Upon depression of the print button BT1, the CPU 210 acquires print settings inputted to the UI screens W1 and W2 at that time point and advances the processing to S22. When the cancel button BT2 is depressed, the CPU 210 suspends the print processing. In S20, as the print setting, at least a sheet size, information indicating the current printing mode (bordered printing mode or borderless printing mode), and information indicating the content of the watermark WM are acquired.

In S22, the CPU prepares the arrangement area based on the acquired print settings. Specifically, the CPU 210 identifies a sheet size and a current printing mode (bordered printing mode or borderless printing mode). When the borderless printing mode is specified, the CPU 210 sets, as the arrangement area, the arrangement area CA1 of FIG. 5B having almost the same size as the sheet size. Otherwise, when the bordered printing mode is specified, the CPU 210 sets the arrangement area CA2 of FIG. 5C having a size smaller than the sheet size by a predetermined margin. The CPU 210 secures a memory area corresponding to the set arrangement area in a buffer area 231 to prepare the arrangement area.

In S25, a target image corresponding to one page is selected from among object images OI corresponding to m pages. In S35, among the object image data, the CPU 210 rasterizes target image data representing the target image. The rasterization processing is processing of converting image data of a format different from BMP into BMP data. The BMP data in the present embodiment is, e.g., RGB image data representing color of each pixel as an RGB value. When the object image data is the RGB image data, the conversion is omitted. The size of the converted target image, i.e. one object image OI, is expanded or reduced to be arranged in the arrangement area.

In S40, the CPU 210 executes color conversion processing for the rasterized target image data. The color conversion processing is processing of converting image data representing a color of each pixel by a first color system (RGB color system, in the present embodiment) to image data representing a color of each pixel by a second color system. Here, the first color system does not correspond any ink used in printing; the second color system (CMYK color system, in the present embodiment) corresponds to one or more inks used in printing. The color conversion processing is executed using a known color profile (e.g., a lookup table) defining the correspondence relationship between the RGB value and the CMYK value.

In S50, the CPU 210 executes mark arrangement processing using the color-converted target image data. The mark arrangement processing is processing for generating arrangement image data representing an arrangement image AI including the target image (object image OI) and the watermark WM by additionally arranging the watermark WM with respect to the target image (object image OI) that has already been arranged in the arrangement area. In FIG. 5B, an example of an arrangement image AI including the object image OI and watermark WM is illustrated. Details of the mark arrangement processing will be described later. The arrangement image data generated through the mark arrangement processing is CMYK image data representing a color of each pixel as a CMYK value.

In S60, the CPU 210 executes halftone processing for the arrangement image data to generate dot data. The dot data is data representing a dot formation state (presence/absence of a dot in the present embodiment) for each pixel. The halftone processing is carried out by using known method in the prior art such as the error diffusion method and the dither method.

In S70, the CPU 210 adds various print commands to the dot data to generate print image data. In S80, the CPU 210 supplies the print image data to the printer 10. The printer 10 prints the arrangement image AI including the target image and the watermark WM to the sheet S according to the supplied print image data.

In S90, the CPU 210 determines whether or not all the pages are processed. When there is any unprocessed page (NO in S90), the CPU 210 returns the processing to S25. When processing of all the pages is completed (YES in S90), the CPU 210 ends the print processing.

As a result, the watermark WM is added to each of m object images corresponding to m pages represented by the object image data, and each of m object images is printed on the sheet S.

A-3. Mark Arrangement Processing

Figure 8:
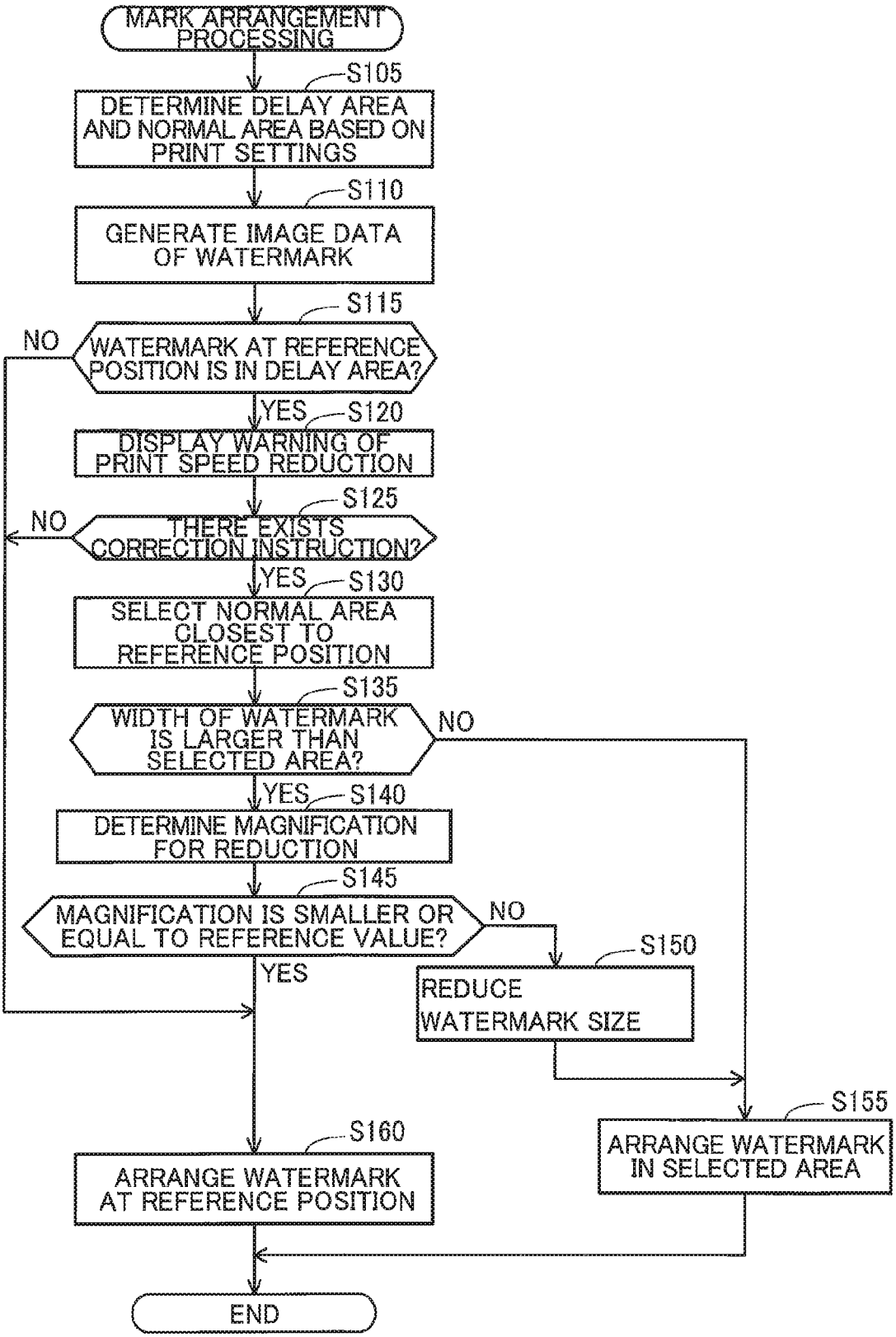
FIG. 8 is a flowchart of mark arrangement processing according to the first embodiment.

FIG. 8 is a flowchart of the mark arrangement processing. In S105, the CPU 210 determines delay area and normal area in the arrangement area based on the print settings acquired in S10 of FIG. 6.

Specifically, the CPU 210 determines the normal areas NA1 to NA3 and delay areas TA1, TA2, MA1, and MA2 in accordance with the sheet size. The head positions P with respect to the sheet S differ for each sheet size, and the normal areas and delay areas to be set on the sheet S differ in accordance with the head positions P with respect to the sheet S. For example, a timing when the downstream end of the sheet S is caught by the sheet discharge roller pair 144 and a timing when the upstream end of the sheet S comes off from the sheet feed roller 141 differ for each sheet size. The difference in the above timings changes the positions of the intermediate delay areas MA1 and MA2 on the sheet S. Further, in a state where the upstream and downstream ends of the sheet S are free ends, the length of the printable area in the conveying direction AR differs for each sheet size so as to ensure print quality. Therefore, the lengths of the end delay areas TA1 and TA2 in the conveying direction AR differ for each sheet size. According to the present embodiment, the normal areas and the delay areas can be set adequately based on the sheet size.

When the borderless printing mode is specified, the CPU 210 determines the four delay areas TA1, TA2, MA1, and MA2 as the delay areas existing in the arrangement area CA1 and determines the three normal areas NA1 to NA3 as the normal areas existing in the arrangement area CA1, as illustrated in FIG. 5B. When the bordered printing mode is specified, the CPU 210 determines the two intermediate delay areas MA1 and MA2 as the delay areas existing in the arrangement area CA2 and determines the three normal areas NA1 to NA3 as the normal areas existing in the arrangement area CA2, as illustrated in FIG. 5C. As described above, when printing is performed in a borderless printing mode, the determined arrangement area CA1 includes the end delay areas TA1 and TA2. When printing is performed in a bordered printing mode, the determined arrangement area CA2 does not include the end delay areas TA1 and TA2. Thus, the delay areas and the normal areas can be adequately set within the arrangement area depending on the printing mode.

Figure 9A:
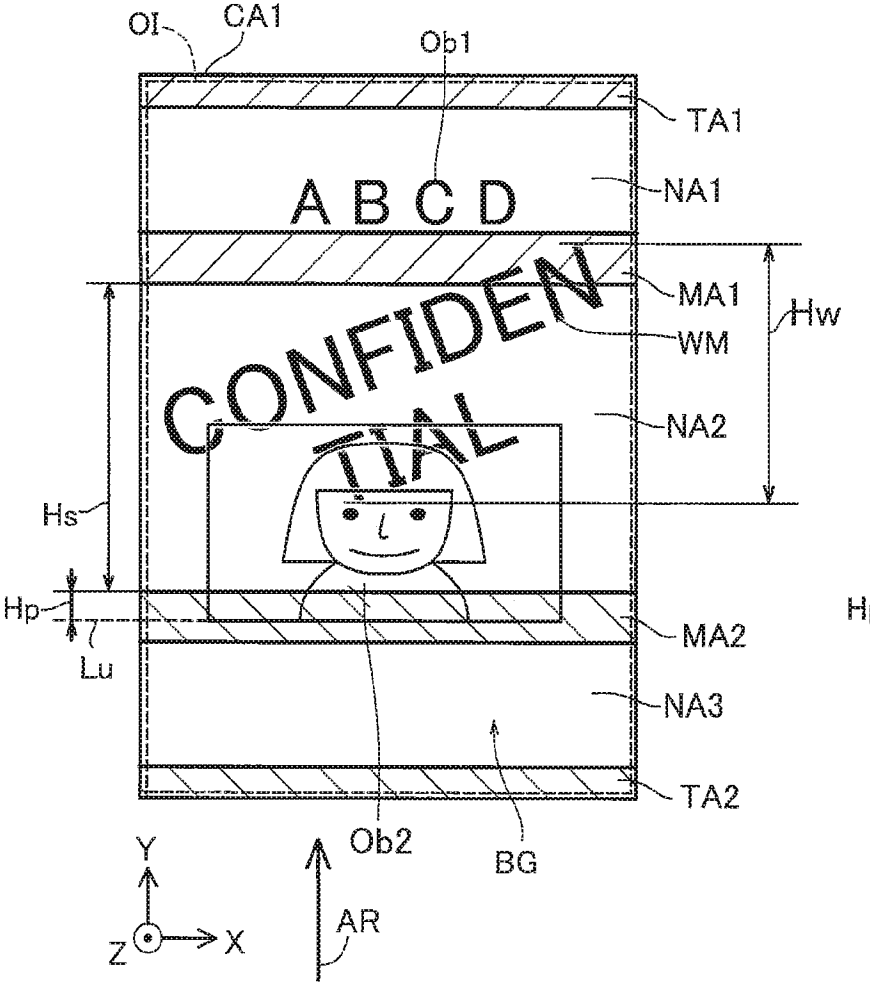
FIG. 9A is an explanatory drawing illustrating a mark arrangement before correction of the watermark in a mark arrangement processing according to the first embodiment.
Figure 9B:
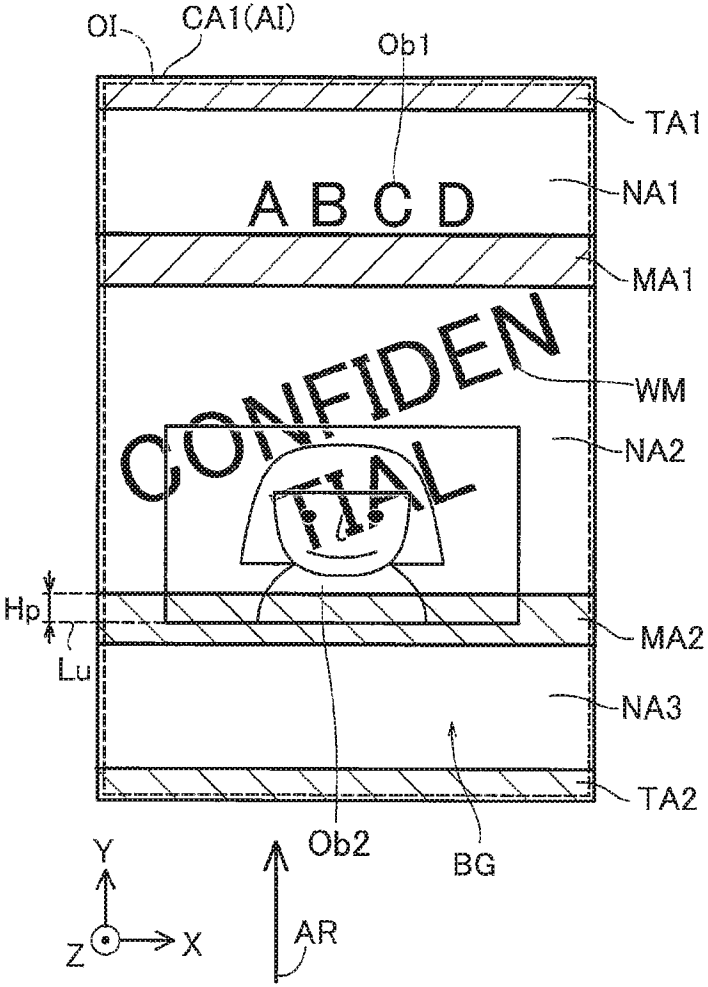
FIG. 9B is an explanatory drawing illustrating the mark arrangement after the correction in the mark arrangement processing according to the first embodiment.

FIGS. 9A and 9B are views for explaining the mark arrangement processing. Hereinafter, description will be made, taking the arrangement area CA1 of FIG. 9A used in the borderless printing mode as an example.

In S110, the CPU 210 generates image data representing the watermark WM. Specifically, the CPU 210 generates image data representing the watermark WM based on settings related to the content of the watermark WM acquired through the advanced setting screen W2 of FIG. 7B. Here, for example, image data representing the watermark WM "CONFIDENTIAL" illustrated in FIG. 9A is generated.

In S115, the CPU 210 determines whether or not at least a part of the watermark WM disposed at a reference position in the arrangement area CA1 is positioned within the delay area. The reference position of the watermark WM is designated by the user through the above advanced setting screen W2 (FIG. 7B). Alternatively, the reference position may be previously determined and may be, for example, the position at which the centroid position of the arrangement area CA1 and that of the watermark WM coincide with each other. It is assumed in FIG. 9A that the watermark WM is disposed at the reference position within the arrangement area CA1 In FIG. 9A, a part of the watermark WM in the vicinity of the downstream end is positioned within the intermediate delay area MAL so that, in S115, the CPU 210 determines that at least a part of the watermark WM is positioned within the delay area.

When the watermark WM is positioned completely outside the delay area (NO in S115), the CPU 210 locates the watermark WM at the reference position in the arrangement area CA1 in S160 and ends the mark arrangement processing.

When at least a part of the watermark WM is positioned within the delay area (YES in S115), the CPU 210 displays a warning about print speed. Specifically, a warning screen W3 of FIG. 7C is displayed on the display unit 270. The warning screen W3 includes buttons BT6 and BY7 and a message MS indicating that the print speed may be reduced due to the position of the watermark WM. The button BT6 is for inputting a correction instruction to automatically correct the position of the watermark WM in the arrangement area CA1 so that the watermark WM is positioned completely outside the delay area. The button BT7 is for inputting an instruction not to correct the position of the watermark WM. When any one of the buttons BT6 and BT7 is depressed on the warning screen W3, the CPU 210 advances the processing to S125.

In S125, the CPU 210 determines whether or not the above correction instruction has been input through the warning screen W3. When the correction instruction has not been input (NO in S125), the CPU 210 locates the watermark WM at the reference position in the arrangement area CA1 in S160 and ends the mark arrangement processing. Thus, when the user does not input the correction instruction although he or she recognizes a possibility of reduction in a print speed, an image as intended by the user is printed.

When the correction instruction has been input (YES in S125), the CPU 210 selects, from among one or more normal areas in the arrangement area CA1, the normal area closest to the reference position in S130. Specifically, the watermark WM at the reference position is moved so as to be positioned completely within the normal area. At this time, a minimum value of the moving amount or distance of the watermark WM in the conveying direction is calculated for each normal area. Then, the normal area from which the watermark WM is moved least is selected as the normal area closest to the reference position. For example, in the example of FIG. 9A, the normal area NA2 which is the closest to the reference position is selected from among the three normal areas NA1 to NA3. This prevents the watermark WM from being moved to an excessively distant position from the user designated reference position.

In S135, the CPU 210 compares a width Hw of the watermark WM in the conveying direction AR and a width Hs of the normal area selected in S130 (also referred to as "selected area") to determine whether or not the width Hw of the watermark WM in the conveying direction AR is larger than the width Hs of the selected area. In the example of FIG. 9A, it is determined that the width Hw of the watermark WM is equal to or smaller than the width Hs of the selected area (normal area NA2).

When the width Hw of the watermark WM is equal to or smaller than the width Hs of the selected area (NO in S135), the CPU 210 locates the watermark WM in the selected area without reducing the size thereof in S155 and ends the mark arrangement processing. As a result, the watermark WM is adequately moved from the reference position so as not to be positioned in the delay area but to be positioned completely within the normal area. For example, in FIG. 9B, the watermark WM is thus moved in S155 to be completely within the normal area NA2.

When the width Hw of the watermark WM is larger than the width Hs of the selected area (YES in S135), the CPU 210 determines a magnification DR ($0<DR<1$) for size reduction of the watermark WM in S140. The magnification DR is set to, e.g., (Hs/Hw) so that the width of the watermark WM after reduction and the width Hs of the selected area coincide with each other. Thus, an adequate magnification can be set for the watermark WM so as to allow the watermark WM after reduction to have the largest possible size within the selected area.

In S145, the CPU 210 determines whether or not the set magnification DR is equal to or smaller than a reference value TH. The reference value TH is set in a range of, e.g., 0.6 to 0.8. When the magnification DR is equal to or smaller than the reference value TH (YES in S145), the CPU 210 locates the watermark WM at the reference position in the arrangement area CA1 without reducing the size thereof in S160 and ends the mark arrangement processing. That is, in this case, the watermark WM is not subjected to correction. Thus, excessive reduction in the size of the watermark WM can be prevented, and generation of an image against the user's intention is hindered.

When the magnification DR is larger than the reference value TH (NO in S145), the CPU 210 reduces the watermark WM based on the magnification DR in S150. The CPU 210 then locates the reduced watermark WM in the selected area in S155, and ends the mark arrangement processing. As a result, the size of the watermark WM is adequately reduced such that the watermark WM is not positioned within the delay area but positioned completely within the normal area, and the position of the watermark WM is moved adequately from the reference position.

According to the first embodiment described above, the following advantages can be obtained. For example, in FIG. 9B, the positions of the object image OI and watermark WM are set in the arrangement area CA2 including the normal areas NA1 to NA3 and delay areas TA1, TA2, MA1 and MA2 such that the object image OI and the watermark WM are positioned within the normal areas NA1 to NA3. In addition, the object image OI is positioned within the delay areas TA1, TA2, MA1, and MA2, but the watermark WM is not positioned therewithin (S22 and S30 of FIG. 6 and S155 of FIG. 8). As a result, in the arrangement image AI to be printed, the watermark WM is positioned within the normal area but is not positioned within the delay area. This can prevent the short conveying operation from being performed depending on the position of the watermark WM. As a result, a time required for printing the arrangement image AI can be prevented from increasing.

For example, as illustrated in FIG. 9B, the object image OI is disposed both in the delay area and the normal area; and the object image OI includes an area not to be printed (that is, an area where dot is not formed) such as an area representing the background BG having a white color. In the example of FIG. 9B, when the arrangement image AI is printed, a part of the drawing Ob2 to be printed is included in the intermediate delay area MA2, but no print target is included in the end delay areas TA1 and TA2, or intermediate delay area MA1. Further, the watermark WM is not included in the delay areas TA1, TA2, MA1 and MA2. Thus, when the image AI of FIG. 9B is printed, printing for the intermediate delay area MA2 is performed, but printing for other delay areas (TA1, TA2, and MA1) is not performed.

Assume that, as in FIG. 9A (state before correction), at least a part of the watermark WM is included in any of the delay areas TA1, TA2, and MA1 in the arrangement area CA1 In this case, when the arrangement image AI is printed, the delay area including the watermark WM needs to be printed in association with printing of the watermark WM. As a result, as compared with a case where printing is performed in a state where the watermark WM is absent in the delay areas TA1, TA2, MA1, and MA2, a printing time may excessively increase. In the present embodiment, such a disadvantage can be avoided. That is, as described above, in the arrangement image AI, the watermark WM is not disposed in the delay area, but in the normal area. Thus, when an image of the arrangement area CA1 including the watermark WM and object image OI disposed at the determined position is printed on the sheet S, the area of an image to be printed in the delay area does not increase in association with printing of the watermark WM. Thus, the position of the watermark WM is determined so that the length of an area to be printed in the delay area in the conveying direction AR is minimized, when printing an image of the arrangement area CA1 including the watermark WM and object image OI disposed at the determined position. If a print target such as an object in the object image OI or a background having a color different from white is not positioned within the delay area, the position of the watermark WM is determined so that the length in the conveying direction AR of an area to be printed in the delay area is 0 (zero).

Further, in the first embodiment, the CPU 210 controls display of the UI screens W1 and W2 (FIGS. 7A and 7B) used for acquisition of instructions (print instruction of the watermark WM and instruction indicating the content of the watermark WM) concerning the watermark WM (S20 of FIG. 6). The CPU 210 then determines the position of the watermark WM in the arrangement image AI when acquiring the instruction concerning the watermark WM. As a result, the position of the watermark WM can be adequately determined based on the instruction from the user and in accordance with the dynamically varying size of the watermark WM.

In the first embodiment, the CPU 210 acquires, through the advanced setting screen W2 of FIG. 7B, an arrangement instruction designating the reference position at which the watermark WM is disposed in its arrangement area (S20 of FIG. 6). Then, when the arrangement instruction instructs that the watermark WM is disposed in the delay area (YES in S115 of FIG. 8), the CPU 210 displays information concerning a printing time on the UI screen W3 of FIG. 7C (S120 of FIG. 8). This allows the user to recognize a possibility of increase in the printing time. Thus, the user can be provided with an opportunity to avoid increase in the printing time, and a disadvantage that the printing time disadvantageously increases against the user's intention can be avoided.

Further, in the first embodiment, image data representing the watermark WM is generated based on the settings of the content of the watermark WM acquired through the advanced setting screen W2, whereby a reference size of the watermark WM is determined. Then, a reference position of the watermark WM is determined based on the user's instruction acquired through the advanced setting screen W2 (FIG. 7B). The CPU 210 determines the position of the watermark WM by carrying out at least one of the moving of the position of the watermark WM from the reference position and the reduction in the size of the watermark WM relative to the reference size (S150 of FIG. 8). Accordingly, the watermark WM is located not within the delay area but within the normal area (S155), and the position of the watermark WM can be adequately determined.

Further, as described above, the reference size and the reference position of the watermark WM are determined based on the instruction acquired from the user. This allows generation of print image data representing the arrangement image AI in which the watermark WM is positioned adequately in accordance with the user's intention.

Further, as described above, in the first embodiment, the conveying mechanism 140 has, on the normal path NR along which the sheet S is conveyed, the sheet feed roller 141 provided upstream of the print head 110 and the sheet discharge roller pair 144 provided downstream of the print head 110. Here, the sheet feed roller 141 serves as the upstream supporting part supporting the sheet S, and the sheet discharge roller pair 144 serves as the downstream supporting part supporting the sheet S. The short conveying operation performed at printing for the intermediate delay area MA2 includes the sheet conveying operation T during which there occurs a shifting from a state where the sheet S is supported by the sheet feed roller 141 to a state where the sheet S is not supported by the sheet feed roller 141. The short conveying operation performed at printing for the intermediate delay area MA1 includes the sheet conveying operation T during which there occurs a shifting from a state where the sheet S is not supported by the sheet discharge roller pair 144 to a state where the sheet S is supported by the sheet discharge roller pair 144. As a result, the short conveying operation is performed as the sheet conveying operation T in which conveying accuracy may be deteriorated due to a variation in a conveying load. Thus, deterioration in conveying accuracy which may occur at printing for the intermediate delay areas MA1 and MA2 can be prevented to thereby restrict occurrence of banding in the intermediate delay areas MA1 and MA2.

Further, in the first embodiment, the delay area includes the end delay areas TA1 and TA2. That is, the short conveying operation is performed at printing for the vicinity of the upstream or downstream end of the sheet S during which conveying accuracy may be deteriorated since both sides of the sheet S cannot be supported. Thus, deterioration in conveying accuracy which may occur at printing for the end delay areas TA1 and TA2 can be prevented to thereby restrict occurrence of banding in the end delay areas TA1 and TA2.

As can be understood from the above, the normal areas NA1 to NA3 of the first embodiment are examples of a first area, and delay areas TA1, TA2, MA1, and MA2 are examples of a second area.

B. Second Embodiment

B-1. Print Processing

Figure 10:
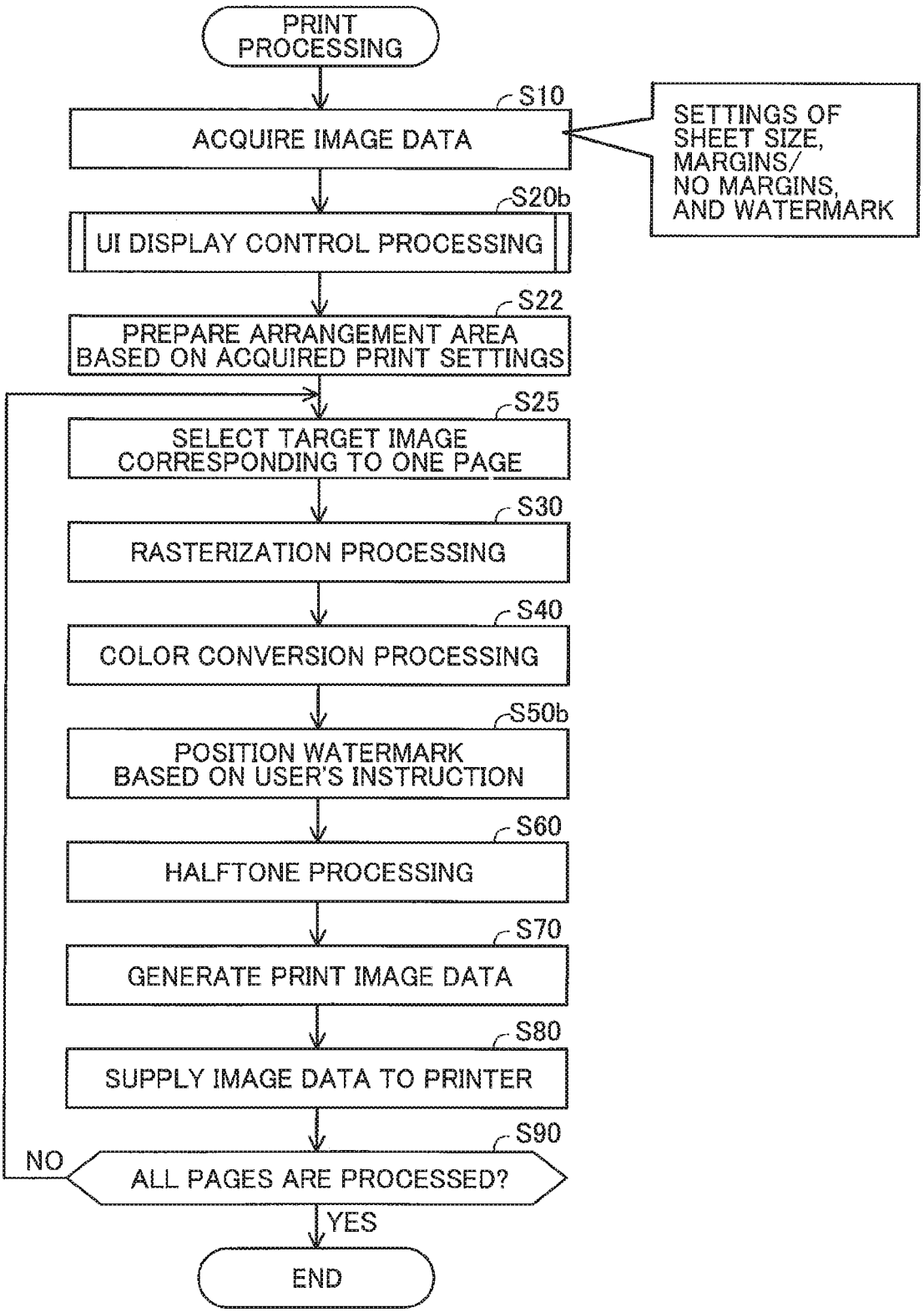
FIG. 10 is a flowchart of print processing according to a second embodiment.

FIG. 10 is a flowchart of print processing according to a second embodiment. In the print processing of FIG. 10, in place of the UI screen control processing of the first embodiment (S20 of FIG. 6), UI screen control processing of the second embodiment (S20*b*) is executed. Accordingly, in place of the mark arrangement processing of the first embodiment (S50 of FIG. 6), processing of S50*b* of FIG. 10 is executed. The processing other than S20*b* and S50*b* of FIG. 10 are the same as those of FIG. 6 to which the same reference numbers are given; therefore, description thereof will be omitted. Although details will be described later, in the UI screen control processing of the second embodiment, the CPU 210 displays the delay area and the normal area in mutually different modes or forms on the UI screen W2*b* that is displayed on the display unit 270 so as to allow the user to easily identify them.

Further, in S50*b*, the CPU 210 locates the watermark WM in the arrangement area based on the user instruction input through the UI screen W2*b* to be described later. That is, in the second embodiment, the watermark WM is disposed at the arrangement position (reference position of the first embodiment) specified or designated by the user on the UI screen W2*b*. If the user does not arrange the watermark WM completely within the normal area, the CPU 210 moves and locates the watermark WM completely within the normal area. Further, the CPU 210 reduces the size of the watermark WM and locates the watermark WM completely within the normal area (recommended area RA), if the following conditions are both satisfied:

the watermark WM cannot be disposed completely within the normal area without reducing the size; and the watermark WM can be disposed completely within the normal area if the size is reduced at a magnification DR larger than a reference value TH.

B-2. UI Screen Control Processing

Figure 11:
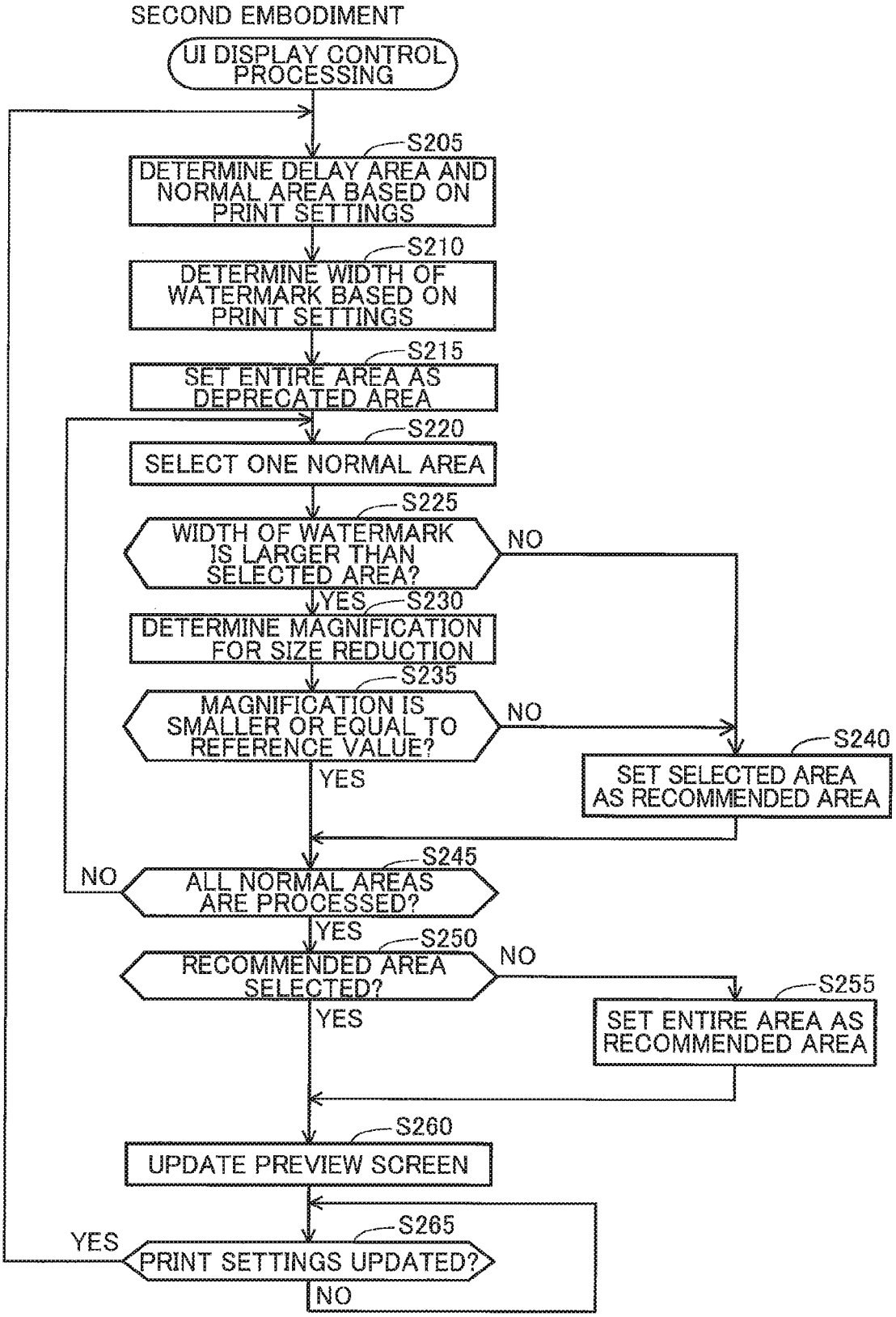
FIG. 11 is a flowchart of UI screen controlling processing according to the second embodiment.
Figure 12A:
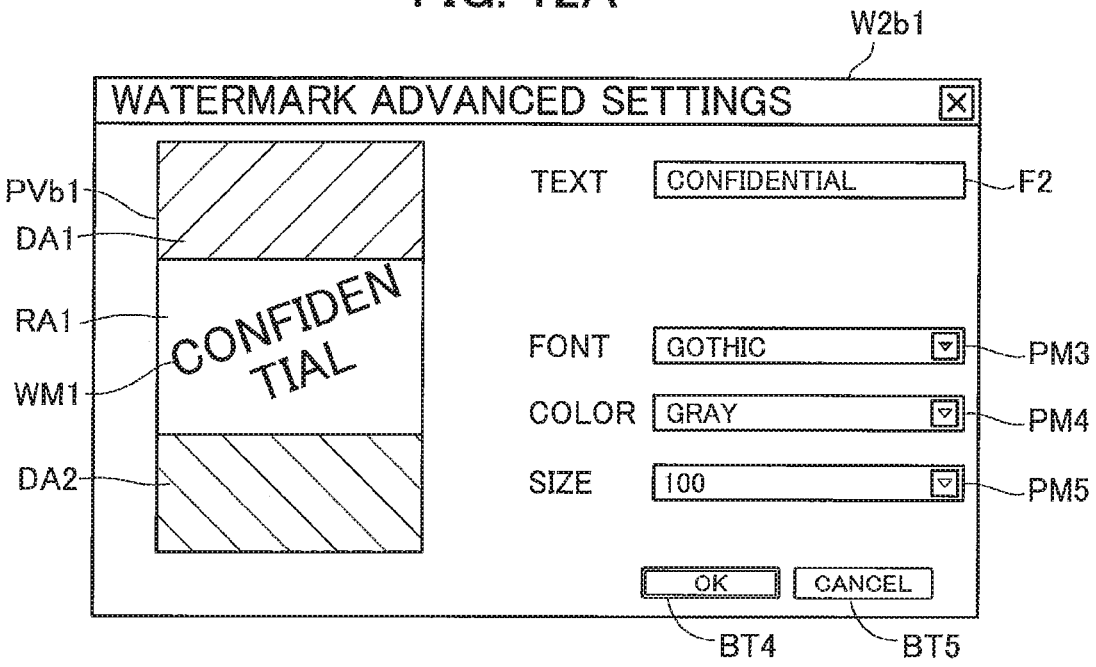
FIGS. 12A and 12B illustrate examples of an advanced setting screen.
Figure 12B:
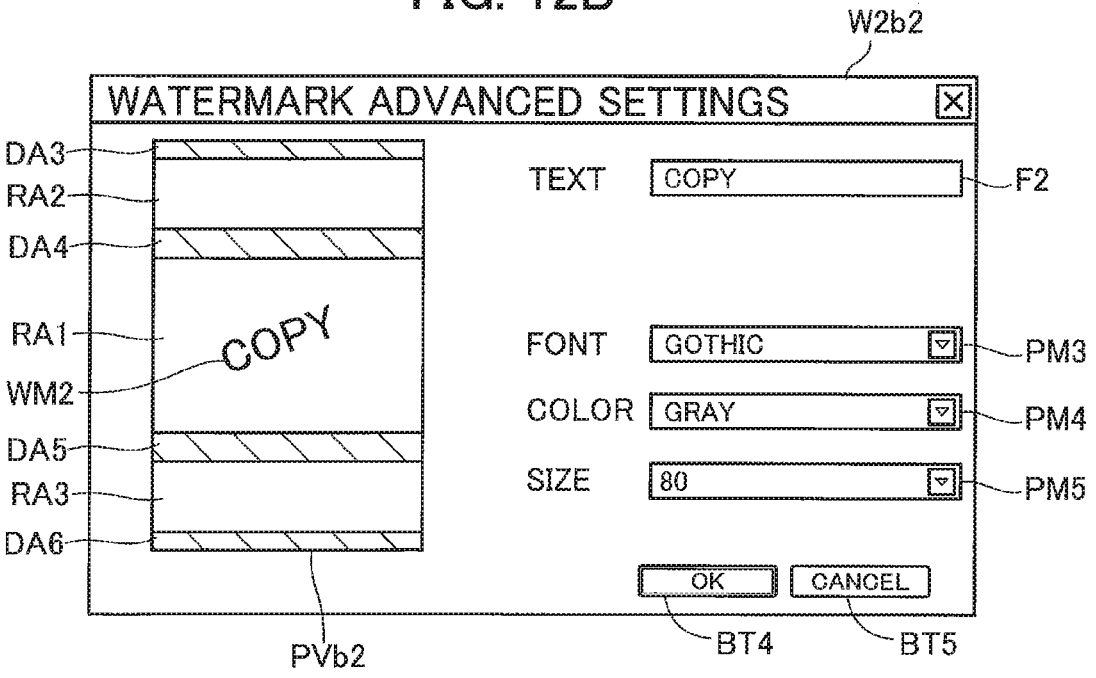

FIG. 11 is a flowchart of the UI screen control processing of the second embodiment. FIGS. 12A and 12B are examples of an advanced setting screen W2*b* of the second embodiment. As examples of the advanced setting screen W2*b*, an advanced setting screen W2*b*1 and an advanced setting screen W2*b*2 are illustrated in FIGS. 12A and 12B, respectively. In the UI screen control processing of the second embodiment, the CPU 210 displays the UI screen on the display unit 270 and acquires print settings therethrough as in the UI screen control processing of the first embodiment. Upon acquisition of the print settings through the main screen W1, the CPU 210 advances the processing to S22.

Here, in place of the advanced setting screen W2 of FIG. 7B, the advanced setting screens W2*b*1 (FIG. 12A) and W2*b*2 (FIG. 12B) are displayed. The basic configurations of the advanced setting screens W2*b*1 and W2*b*2 are the same as that of the advanced setting screen W2 of FIG. 7B. However, although details will be described later, on preview screens PVb1 and PVb2 of the respective advanced setting screens W2*b*1 and W2*b*2, a recommended area RA and a deprecated area DA can be displayed in addition to the watermarks W1 and W2. The recommended area RA is the area in which the layout of the watermarks W1 and W2 is recommended because the printing time is less likely to increase, and deprecated area DA is the area in which the layout of the watermarks W1 and W2 is not recommended because the printing time is more apt to increase. In the example of FIG. 12A, one recommended area RA1 is illustrated as the recommended area RA. In the example of FIG. 12B, three recommended areas RA1 to RA3 are illustrated as the recommended area RA. The user can input, through the preview screens PVb1 and PVb2, an instruction to specify the position of the watermark WM in the arrangement area.

While the advanced setting screen W2*b* (e.g., W2*b*1 or W2*b*2) is displayed on the display unit 270, the processing of the flowchart of FIG. 11 is executed, and display of the preview screen PVb is updated as needed.

In S205, the CPU 210 sets the delay area and the normal area in the arrangement area based on the print settings inputted through the main screen W1, specifically, the sheet size currently selected in the pull-down menu PM1 and printing mode currently selected in the radio button RB2.

Specifically, as in S105 of FIG. 8, the CPU 210 determines the normal areas NA1 to NA3 and delay areas TA1, TA2, MA1, and MA2 in accordance with the sheet size. Then, when the borderless printing mode is specified, the CPU 210 determines the four delay areas TA1, TA2, MA1, and MA2 as the delay areas existing in the arrangement area CA1 The CPU 210 then determines the three normal areas NA1 to NA3 as the normal areas existing in the arrangement area CA1, as illustrated in FIGS. 5B and 9A. When the bordered printing mode is specified, the CPU 210 determines the two intermediate delay areas MA1 and MA2 as the delay areas existing in the arrangement area CA2 and determines the three normal areas NA1 to NA3 as the normal areas existing in the arrangement area CA2, as illustrated in FIG. 5C. Hereinafter, it is assumed that the four delay areas TA1, TA2, MA1, and MA2 are determined as the delay areas existing in the arrangement area CA1.

In S210, the CPU 210 determines the watermark WM based on the print settings input through the advanced setting screen W2*b*, i.e., the current settings concerning the content of the watermark WM and determines the width Hw (FIG. 9A) of the determined watermark WM.

In S215 to S255, the CPU 210 sets the above recommended area RA and deprecated area DA in the arrangement area CA1 In S215, the CPU 210 sets an initial state where the entire arrangement area CA1 is the deprecated area DA.

In S220, the CPU 210 selects one normal area as a selected area from among the three normal areas NA1 to NA3 set in the arrangement area CA1 in S205.

In S225, the CPU 210 compares the width Hw of the watermark WM and the width Hs of the normal area (selected area) selected in S220 to determine whether or not the width Hw of the watermark WM is larger than the width Hs of the selected area. When the normal area NA2 of FIG. 9A is the selected area, the width Hw of the watermark WM is smaller than the width Hs of the normal area NA2, so that it is determined that the width Hw of the watermark WM is equal to or smaller than the width Hs of the selected area. When the normal area NA1 or NA3 of FIG. 9A is the selected area, it is determined that the width Hw of the watermark WM is larger than the width Hs of the selected area.

When the width Hw of the watermark WM is equal to or smaller than the width Hs of the selected area (NO in S225), the CPU 210 sets the selected area as the recommended area RA in S240 and then advances the processing to S245. As a result, the normal area having a width large enough to completely include the watermark WM as it is (without reducing the size of the watermark WM) is set as the recommended area RA. In the example of FIG. 9A, the normal area NA2 is set as the recommended area RA.

When the width Hw of the watermark WM is larger than the width Hs of the selected area (YES in S225), the CPU 210 determines the magnification DR for reduction of the watermark WM in S230 ($0<DR<1$, $DR=(Hs/Hw)$), as in S140 of FIG. 8.

In S235, the CPU 210 determines whether or not the determined magnification DR is equal to or smaller than a reference value TH. The reference value is set in a range of, e.g., 0.6 to 0.8.

When the magnification DR is larger than the reference value TH (NO in S235), the CPU 210 sets the selected area as the recommended area RA in S240 and advances the processing to S245. As a result, the normal area having a width within which the watermark WM can be positioned by being reduced at a magnification larger than the reference value TH is set as the recommended area RA.

When the magnification DR is equal to or smaller than the reference value TH (YES in S235), the CPU 210 advances the processing to S245 without setting the selected area as the recommended area RA. As a result, the normal area within which the watermark WM cannot be positioned unless it is excessively reduced is not set as the recommended area RA. In the example of FIG. 9A, the normal areas NA1 and NA2 are not set as the recommended area RA.

In S245, the CPU 210 determines whether or not all the normal areas have been processed as the selected area. When there is any unprocessed area (NO in S245), the CPU 210 returns to S220 and selects the unprocessed normal area. When all the normal areas have been processed (YES in S245), the CPU 210 determines, in S250, whether or not at least one recommended area RA is set in the arrangement area CA1.

When at least one recommended area RA is set in the arrangement area CA1 (YES in S250), the CPU 210 advances the processing to S260. When no recommended area is set (NO in S250), the CPU 210 sets the entire arrangement area CA1 as the recommended area RA in S255 and advances the processing to S260. This is because when no recommended area RA is set, the recommended area RA cannot be presented to the user, which may embarrass him or her.

As can be understood from the above, the delay area in the arrangement area CA1 is set as the deprecated area DA excluding a case where the entire arrangement area CA1 is set as the recommended area RA.

In S260, the CPU 210 updates the preview screen PV on the advanced setting screen W2*b* of FIGS. 12A and 12B. On the advanced setting screen W2*b*, the deprecated area DA and recommended area RA are displayed in mutually different forms so as to allow the user to easily identify them. For example, on the preview screen PVb, the deprecated area DA and the recommended area RA are displayed in different colors. For example, FIG. 12A illustrates the advanced setting screen W2*b*1 including the preview screen PVb1 displaying the watermark WM1 of FIG. 9A. In this example, the CPU 210 displays a deprecated area DA1 corresponding to the delay areas TA1 and MA1 and normal area NA1 on the upstream side of the FIG. 9, a deprecated area DA2 corresponding to the delay areas TA2 and MA2 and normal area NA3, and a recommended area RA1 corresponding to the normal area NA2.

FIG. 12B illustrates the advanced setting screen W2*b*2 including the preview screen PVb2 displaying a watermark WM2 having a width smaller than that of the watermark WM1 of FIG. 12A. In this example, the CPU 210 displays: four deprecated areas DA3 to DA6 respectively corresponding to the four delay areas TA1, TA2, MA1, and MA2 of FIG. 9A; and three recommended areas RA1 to RA3 respectively corresponding to the three normal areas NA1 to NA3.

As can be seen from the above, when the width of the watermark WM is less than a reference value, the comparatively large normal area NA2 and comparatively smaller normal areas NA1 and NA3 are displayed on the advanced setting screen W2*b*2 (FIG. 12B) as the recommended area RA (RA1 to RA3) in a display form different from that of the delay area (deprecated areas DA3 to DA6) (FIG. 12B). On the other hand, when the width of the watermark WM is equal to or larger than a reference value, the comparatively large normal area NA2 is displayed on the advanced setting screen W2*b*1 (FIG. 12A) as the recommended area RA (RA1), while the comparatively smaller normal areas NA1 and NA3 are displayed as the deprecated area DA (DA1 and DA2). That is, the comparatively large normal area NA2 is displayed in a display form different from that of the delay area, and the comparatively small normal areas NA1 and NA3 are displayed in the same display form as that of the delay area (FIG. 12A). As a result, the recommended area RA and deprecated DA are displayed in an adequate form in accordance with the width of the watermark WM. Thus, as compared with a case where the delay area and normal area are displayed simply, the area suitable for the watermark WM can be easily identified by the user.

In S265, the CPU 210 determines whether or not any of the print settings input to the main screen W1 or advanced setting screen W2*b*, for example, a setting related to the sheet size or watermark WM, has been updated. When any of the print settings has been updated (YES in S265), the CPU 210 returns the processing to S205 to update the preview screen PV in response to the update of the print setting. When no print setting has been updated (NO in S265), the CPU 210 waits until any of the print settings is updated.

According to the second embodiment described above, an instruction concerning the watermark WM acquired through the advanced setting screen W2 includes an instruction specifying a position of the watermark WM. The CPU 210 displays, on the advanced setting screen W2*b*, the deprecated area DA including all the delay areas and recommended area RA including at least one normal area NA in mutually different display forms (S260, FIGS. 12A and 12B). This allows the user to identify the recommended area RA including the normal area where the printing time is unlikely to increase and the deprecated area DA where the printing time is likely to increase. Thus, on the advanced setting screen W2*b*, the user can be prompted to input an instruction to locate the watermark WM not in the delay area and within the normal area on the advanced setting screen W2*b*. As a result, with high probability, the user can adequately input an arrangement instruction that does not increase the printing time.

The following configuration may be adopted as a modification. That is, in user's operation of a pointing device such as a mouse, the watermark WM is prohibited from moving to the deprecated area, but allowed to be moved only within the recommended area. Thus, an arrangement instruction to locate the watermark WM not in the delay area but in the normal area can be acquired reliably from the user.

As can be understood from the above, the normal area NA2 of the second embodiment is an example of a first partial area, and normal areas NA1 and NA3 are examples of a second partial area.

C. Third Embodiment

Figure 13:
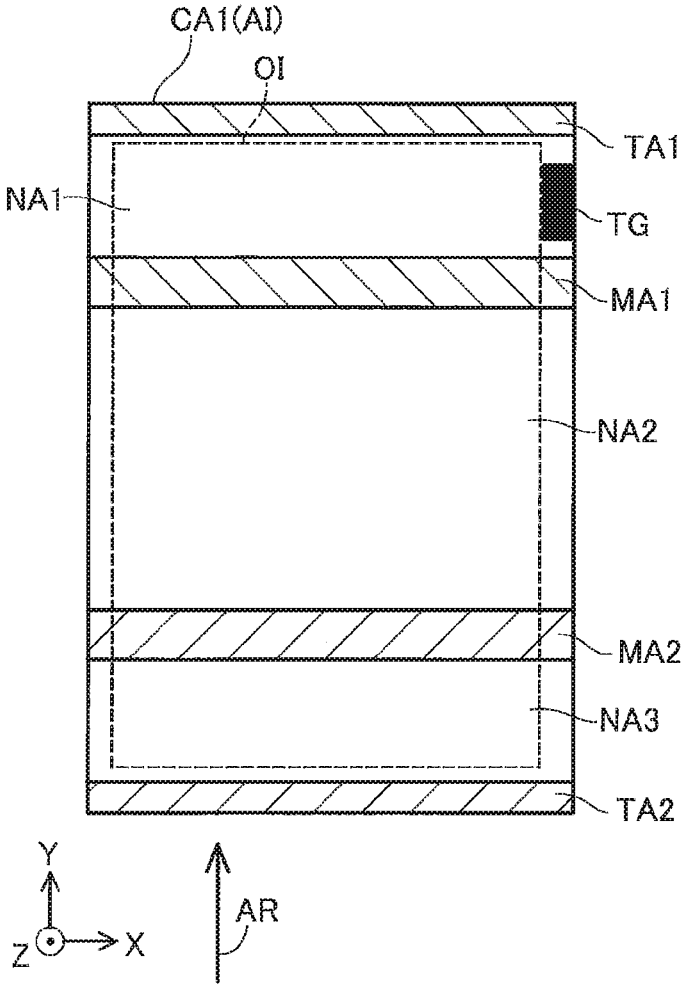
FIG. 13 is an explanatory drawing of a sheet and a tag according to a third embodiment.

In the above first and second embodiments, an additional image to be added to the object image OI is the watermark WM, but not limited thereto. FIG. 13 is an explanatory view illustrating a third embodiment. In the third embodiment, a tag TG is added in the arrangement area CA1 as the additional image in place of the watermark WM. The tag TG is added to a position along one side end (+X side end) in the main scan direction of the sheet S. Thus, even when one or more sheets are placed on a specific sheet S, the user can recognize the tag TG printed on the specific sheet S. For example, the tag TG is an image having a rectangular shape and solidly painted in a single color. Thus, image data representing the tag TG is data including a color value representing the color of the tag TG and information indicating the rectangular size of the tag TG.

The tag TG is added for a user to efficiently classify a plurality of printed sheets. For example, when images corresponding to M (M is an integer equal to or larger than 2) pages per one set are printed by N (N is an integer equal to or larger than 2) sets, that is, images corresponding to (M×N) pages are printed, the tag TG is added as an image representing the first page of each N set. This facilitates classification of the (M×N) sheets into a plurality of sets. When the number M of pages per set is comparatively small, the tag TG may be added such that the color or position thereof is different for each set. Further, the tag TG may be added only when the number M of pages per set is comparatively large, and therefore, a load of the classification work is relatively high. Further, the tag TG may be added such that the color or position thereof is different for each print job, for each user instructing the print job, or for each terminal (e.g., terminal device 200) transmitting the print job. This facilitates classification of a plurality of sheets based on print job, user, or terminal.

As described above, the tag TG is printed along the end of the sheet S, so that printing of the tag TG is performed in the borderless printing mode. As illustrated in FIG. 13, in the arrangement area CA1 used in the borderless printing mode, the position of the tag TG is determined so as to be positioned in a margin area outside the object image OI. The tag TG has, for example, a predetermined size, so that the position of the tag TG is predetermined based on a sheet size. Like the watermark WM, the tag TG is disposed in any one of the normal areas NA1 to NA3, not in any of the delay areas TA1, TA2, MAL and MA2. As a result, a printing time required for printing the arrangement image AI including the object image OI and tag TG can be prevented from increasing.

(1) The additional image is not limited to the watermark WM or tag TG, but may be a footer, a header, or a trace pattern. The trace pattern is a specific pattern for tracing a device that prints securities such as bills or stamps.

D. Modification (2) In the above first embodiment, as illustrated in FIG. 9B, the watermark WM is disposed in the arrangement area CA1 so as to be completely included within the normal area NA2. Alternatively, when a print target in the object image OI is included in the delay area, a part of the watermark WM may be positioned within the delay area to the extent that the length (width) of the print target in the delay area in the conveying direction AR is no longer increased. For example, in the example of FIG. 9B, a position Lu of the upstream end of the drawing Ob2 to be printed is positioned within the intermediate delay area MA2. Accordingly, the upstream end of the drawing Ob2 having a width Hp is included in the intermediate delay area MA2. Thus, the upstream end of the watermark WM of FIG. 9B may be positioned within the intermediate delay area MA2 unless it is positioned upstream of the position Lu corresponding to the upstream end of the drawing Ob2. In other words, even when a part of the watermark WM is positioned within the delay area, there is no problem as long as the width Hp of the print target in the delay area is not increased in association with the arrangement of the watermark WM. With this configuration, the position of the watermark WM can be determined so that the length of the print target in the delay area in the conveying direction AR is minimized when an image in the arrangement area CA1 including the watermark WM and the object image OI disposed at the determined position is printed.

(3) In printing processing for segments in the delay area in the above embodiments, the three sheet conveying operations between the four partial printing operations include at least one short conveying operation, i.e., the conveying operation in which the conveying amount or distance is smaller than that in the normal conveying operation. Alternatively, the sheet conveying operation in printing for the delay area may include a conveying operation in which the conveying distance is the same as that in the normal conveying operation and the conveying speed is lower than that in the normal conveying operation. Even in this case, conveying accuracy can be prevented from being lowered by decreasing the conveying speed of the sheet conveying operation. In this case, the conveying speed of the sheet conveying operation is lowered. Consequently, a printing time required for printing an image in each of the delay areas TA1, TA2, MA1, and MA2 increases as compared with a printing time required for printing an image in each of the normal areas NA1 and NA2. Further, the sheet conveying operation for the delay area may include a conveying operation in which the conveying distance is smaller than that in the normal conveying operation and the conveying speed is lower than that in the normal conveying operation.

Further, in printing for the delay area, the sheet conveying operation may include the short conveying operation in which the conveying distance is smaller than that in the normal area, and the number of the partial printing operations (so-called pass number) in each segment area may be increased as compared with that in the normal area, thereby increasing a print resolution. Even in this case, image quality deterioration ascribable to the lowering of conveying accuracy can be suppressed. In such a printing operation for the delay area, a printing time per unit area is increased as compared with the printing for the normal area.

(4) The delay areas TA1, TA2, MA1, and MA2 in the above embodiments are illustrative and not limited thereto. For example, the short conveying operation may be performed for an area where the conveyed sheet S is bent significantly, and an area printed by the partial printing operations SP before and after the short conveying operation may be set as the delay area. The state where the sheet S is bent significantly is, for example, a state where the sheet passes through the outer guide member 18*a* of FIG. 2 and the inner guide members 19*a* and 19*b*. Further, the sheet conveying operation T when the upstream end of the sheet S comes off from the upstream side conveying roller pair 142 may be set as the short conveying operation, and an area printed by the partial printing operations SP before and after the short conveying operation may be set as the delay area. In either case, because of the short conveying operation, the conveying accuracy can be prevented from being lowered by setting the sheet conveying operation T in the area where the lowering of the conveying accuracy is likely to occur. In such a printing operation for the delay area, a printing time per unit area is increased as compared with the printing for the normal area.

(5) In the mark arrangement processing of the first embodiment, the watermark WM is disposed within the area (normal area) other than the four delay areas TA1, TA2, MA1, and MA2 in consideration of all the four delay areas TA1, TA2, MA1, and MA2. Alternatively, the mark arrangement processing may be performed in consideration of only some of the delay areas TA1, TA2, MA1, and MA2 where the printing time can be increased in the actual printing operation. That is, the mark arrangement processing may be performed with the area other than the considered delay area set as the normal area. For example, unlike the first embodiment, even in the borderless printing mode, the mark arrangement processing may be performed with only the intermediate delay areas MA1 and MA2 set as the delay area, and the area (area including the end delay areas TA1 and TA2 and normal areas NA1 to NA3) other than the intermediate delay areas MA1 and MA2 set as the normal area. In this case, the short conveying operation is performed in printing for the normal area.

(6) The terminal device 200 as the control device that executes the print processing of FIGS. 6 and 8 may be a device of a type different from a personal computer such as the printer 10, a digital camera, a scanner, or a smartphone. When the printer 10 executes the print processing of FIG. 4, the control unit 150 of the printer 10 executes the print processing of FIGS. 6 and 10 to make the printing mechanism 100 of the printer 10 print the arrangement image AI. Further, the control device that executes the print processing of FIGS. 6 and 10 may be a server that can communicate with the terminal device 200 or printer 10 over the Internet. In this case, the server acquires the object image data from the terminal device 200 or printer 10, executes the print processing of FIGS. 6 and 10, and supplies generated print data to the terminal device 200 or printer 10. The server may be a plurality of computers that can communicate with each other over a network. In this case, the plurality of computers correspond to the control device.

(7)A part of the configuration realized by hardware in the embodiments may be replaced by software, or on the contrary, a part of the configuration realized by software in the embodiments may be replaced by hardware. For example, a part of the processing executed by the CPU 210 of the terminal device 200 of FIG. 1 may be realized by a dedicated hardware circuit.

While the description has been made in detail with reference to specific embodiments thereof, it would be apparent to those skilled in the art that various changes and modifications may be made therein without departing from the spirit and scope of the above described embodiments.

What is claimed is:

1. A system comprising:

a printer; and a control device configured to control the printer, the printer comprising:

a conveyer configured to convey a sheet in a first direction, the conveyer including a plurality of sheet conveying parts which are disposed apart from one another by predetermined distances in the first direction and are configured to convey the sheet while supporting the sheet;

a print head having a plurality of nozzles each configured to eject a droplet of ink onto the sheet, where the plurality of sheet conveying parts includes:

a sheet feeding part upstream of the print head in the first direction;

an upstream supporting part positioned downstream of the sheet feeding part and upstream of the print head in the first direction;

a downstream supporting part positioned downstream of the print head in the first direction; and a sheet discharging part positioned downstream of the downstream supporting part in the first direction; and a control unit configured to control the conveyor and the print head to print a print image on the sheet by alternately performing a sheet conveying and a partial printing plural times, the control unit performing the sheet conveying by controlling the conveyor to convey the sheet in the first direction, the control unit performing the partial printing to print a partial print image in a band-like area extending in a second direction on the sheet by controlling the print head to eject droplets of ink onto the sheet while controlling the print head to move in the second direction and controlling the conveyor to stop conveying the sheet in the first direction, the second direction crossing the first direction, the control unit performing the sheet conveying and the partial printing such that a first area and a second area are defined on the sheet at positions different from each other in the first direction, the first area being defined as such an area that while an image in the first area is printed, the sheet conveying including a first conveying is performed at least once, the second area being defined as such an area that while an image in the second area is printed, the sheet conveying including a second conveying different from the first conveying is performed at least once and a number of the sheet conveying parts that are supporting the sheet varies, printing an image in the second area taking time longer than printing an image in the first area because of the difference of the sheet conveying between in the first area and in the second area, the control device comprising:

a processor including hardware, and a memory storing computer-readable instructions therein, the computer-readable instructions, when executed by the processor, causing the control device to perform:

acquiring object image data representing an object image and additional image data representing an additional image to be added to the object image;

determining positions of the first area and the second area in an arrangement area corresponding to the sheet at least based on positions of the plurality of sheet conveying parts in the first direction;

determining a first position of the object image and a second position of the additional image in the arrangement area, wherein the second position of the additional image is determined such that the additional image has a first length in the first direction within the second area and the first length is minimized, where the first length is greater than or equal to zero;

generating arrangement image data representing an arrangement image including the object image and the additional image by arranging, in the arrangement area, the object image and the additional image respectively at the first position and the second position that are determined in the determining; and supplying, to the printer, print image data generated by using the arrangement image data, the control unit of the printer controlling the conveyor and the print head based on the print image data supplied from the control device such that the object image and the additional image are printed on the sheet respectively at the first position and the second position determined in the determining.

2. The system according to claim 1, wherein, in the determining of the second position, the second position is determined such that the additional image is positioned within the first area and outside the second area, the control unit controlling the conveyor and the print head based on the print image data supplied from the control device such that an entire part of the additional image is printed while the image in the first area is printed, and no part of the additional image is printed while the image in the second area is printed.

3. The system according to claim 1, wherein the control unit of the printer controls the conveyor to convey the sheet for a first distance in the first conveying and convey the sheet for a second distance less than the first distance in the second conveying.

4. The system according to claim 1, wherein, in the determining of the second position, the second position is determined such that the additional image has at least a portion in a margin area of the arrangement area, the margin area being positioned outside the object image.

5. The system according to claim 1, wherein, the computer-readable instructions, when executed by the processor, cause the control device further perform controlling a user interface screen to acquire, from a user, an instruction as to the additional image; and wherein, in the determining of the second position, the second position is determined in response to the acquisition of the instruction as to the additional image.

6. The system according to claim 5, wherein the instruction as to the additional image includes designating the second position;

wherein the computer-readable instructions, when executed by the processor, cause the control device to further perform displaying the second area and at least a part of the first area in mutually different forms in the user interface screen.

7. The system according to claim 6, wherein the first area includes a first partial area and a second partial area having a second length in the first direction less than that of the first partial area; and wherein the computer-readable instructions, when executed by the processor, cause the control device to further perform:

determining an entire length in the first direction of the additional image;

displaying both of the first partial area and the second partial area in a form different from that of the second area in the user interface screen, when the first length is less than a threshold; and displaying the first partial area in a form different from that of the second area in the user interface screen and displaying the second partial area in a form same as that of the second area in the user interface screen, when the first length is greater than or equal to the threshold.

8. The system according to claim 5, wherein the instruction as to the additional image includes an arrangement instruction designating the second position; and wherein the computer-readable instructions, when executed by the processor, cause the control device to further perform displaying information about printing time in response to the acquisition of the arrangement instruction instructing to arrange the additional image in the second area.

9. The system according to claim 1, wherein the computer-readable instructions, when executed by the processor, cause the control device further perform setting a reference size and a reference position of the additional image in the arrangement area; and wherein, by performing one of reducing the reference size and displacing the reference position in the determining, the second position is determined such that the first length of the additional image at the second position is minimized, where the first length is within the range greater than or equal to zero.

10. The system according to claim 9, wherein one of the reference size and the reference position is set in accordance with a user's instruction acquired from a user.

11. The system according to claim 1, wherein the determining of the first area and the second area is further based on a size of the sheet.

12. The system according to claim 1, wherein the second area defined on the sheet includes:

an upstream end portion positioned along an upstream end of the sheet in the first direction and extending in the second direction, the upstream end portion having a predetermined length in the first direction;

an upstream intermediate portion positioned downstream of the upstream end portion in the first direction and extending in the second direction, the upstream intermediate portion having a predetermined length in the first direction;

a downstream intermediate portion positioned downstream of the upstream intermediate portion in the first direction and extending in the second direction, the downstream intermediate portion having a predetermined length in the first direction; and a downstream end portion positioned along a downstream end of the sheet in the first direction and extending in the second direction, the downstream end portion having a predetermined length in the first direction, and wherein the first area defined on the sheet includes:

an upstream-side portion defined between the upstream end portion and the upstream intermediate portion in the first direction;

an intermediate portion defined between the upstream intermediate portion and the downstream intermediate portion in the first direction; and a downstream-side portion defined between the downstream intermediate portion and the downstream end portion in the first direction, wherein the control unit of the printer controls the conveyor such that the second conveying includes:

conveying the sheet from a state where the sheet is unsupported by the downstream supporting part to a state where the sheet is supported by the downstream supporting part, while the print head prints an image in the downstream end portion of the second area;

conveying the sheet from a state where the sheet is unsupported by the sheet discharging part to a state where the sheet is supported by the sheet discharging part, while the print head prints an image in the downstream intermediate portion of the second area;

conveying the sheet from a state where the sheet is supported by the sheet feeding part to a state where the sheet is unsupported by the sheet feeding part, while the print head prints an image in the upstream intermediate portion of the second area; and conveying the sheet from a state where the sheet is supported by the upstream supporting part to a state where the sheet is unsupported by the upstream supporting part, while the print head prints an image in the upstream end portion of the second area, and wherein the second position of the additional image is determined such that an entire part of the additional image is disposed within either one of the upstream-side portion, the intermediate portion, and the downstream-side portion and no part of the additional image is overlapped with any one of the upstream end portion, the upstream intermediate portion, the downstream intermediate portion, and the downstream end portion.

13. The system according to claim 12, wherein the printer is configured to print in a first printing mode in which an image in each of the upstream end portion and the downstream end portion of the second area is printed and in a second printing mode in which an image in each of the upstream end portion and the downstream end portion of the second area is excluded from printing, wherein the computer-readable instructions, when executed by the processor, cause the control device to further perform:

selecting either one of the first printing mode and the second printing mode as a printing mode, wherein the positions of the first area and the second area are determined in the arrangement area further based on the selected printing mode such that the position of each of the upstream end portion and the downstream end portion of the second area is determined in the arrangement area in a case where the first printing mode is selected, each of the upstream end portion and the downstream end portion is not determined in the arrangement area in a case where the second printing mode is selected.

14. A method for controlling a printer, the printer comprising: a conveyer configured to convey a sheet in a first direction, the conveyer including a plurality of sheet conveying parts which are disposed apart from one another by predetermined distances in the first direction and are configured to convey the sheet while supporting the sheet; a print head having a plurality of nozzles each configured to eject a droplet of ink onto the sheet, the plurality of sheet conveying parts including: a sheet feeding part upstream of the print head in the first direction; an upstream supporting part positioned downstream of the sheet feeding part and upstream of the print head in the first direction; a downstream supporting part positioned downstream of the print head in the first direction; and a sheet discharging part positioned downstream of the downstream supporting part in the first direction; and a control unit configured to control the conveyor and the print head to print a print image on the sheet by alternately performing a sheet conveying and a partial printing plural times, the control unit performing the sheet conveying by controlling the conveyor to convey the sheet in the first direction, the control unit performing the partial printing to print a partial print image in a band-like area extending in a second direction on the sheet by controlling the print head to eject droplets of ink onto the sheet while controlling the print head to move in the second direction and controlling the conveyor to stop conveying the sheet in the first direction, the second direction crossing the first direction, the control unit performing the sheet conveying and the partial printing such that a first area and a second area are defined on the sheet at positions different from each other in the first direction, the first area being defined as such an area that while an image in the first area is printed, the sheet conveying including a first conveying is performed at least once, the second area being defined as such an area that while an image in the second area is printed, the sheet conveying including a second conveying different from the first conveying is performed at least once, printing an image in the second area taking time longer than printing an image in the first area because of the difference of the sheet conveying between in the first area and in the second area, the method comprising:

acquiring object image data representing an object image and additional image data representing an additional image to be added to the object image;

determining positions of the first area and the second area in an arrangement area corresponding to the sheet at least based on positions of the plurality of sheet conveying parts in the first direction;

determining a first position of the object image and a second position of the additional image in the arrangement area, wherein the second position of the additional image is determined such that the additional image has a first length in the first direction within the second area and the first length is minimized, where the first length is greater than or equal to zero;

generating arrangement image data representing an arrangement image including the object image and the additional image by arranging, in the arrangement area, the object image and the additional image respectively at the first position and the second position that are determined in the determining; and supplying, to the printer, print image data generated by using the arrangement image data, the control unit of the printer controlling the conveyor and the print head based on the print image data supplied from the control device such that the object image and the additional image are printed on the sheet respectively at the first position and the second position determined in the determining.

15. The method according to claim 14, wherein the determining positions of the first area and the second area is further based on a size of the sheet.

* * * * *